US007941081B2

(12) United States Patent
Sakai

(10) Patent No.: US 7,941,081 B2
(45) Date of Patent: May 10, 2011

(54) DEVELOPING UNIT AND IMAGE FORMING APPARATUS USING THE SAME

(75) Inventor: Masahiro Sakai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 710 days.

(21) Appl. No.: 11/968,839

(22) Filed: Jan. 3, 2008

(65) Prior Publication Data

US 2008/0181677 A1 Jul. 31, 2008

(30) Foreign Application Priority Data

Jan. 25, 2007 (JP) ..... 2007-015121

(51) Int. Cl.
*G03G 15/09* (2006.01)

(52) U.S. Cl. ..... 399/277

(58) Field of Classification Search ..... 399/277
See application file for complete search history.

(56) References Cited

U.S. PATENT DOCUMENTS

| | | | | |
|---|---|---|---|---|
| 5,283,615 | A | 2/1994 | Yokoyama et al. | |
| 6,047,154 | A | 4/2000 | Kawaguchi | |
| 6,681,092 | B2 * | 1/2004 | Terai | 399/267 |

FOREIGN PATENT DOCUMENTS

| | | | |
|---|---|---|---|
| JP | 62-50779 | A | 3/1987 |
| JP | 3-171167 | A | 7/1991 |
| JP | 11-95557 | A | 4/1999 |
| JP | 11-237788 | A | 8/1999 |
| JP | 11-311903 | A | 11/1999 |
| JP | 2006-215402 | | 8/2006 |

* cited by examiner

*Primary Examiner* — David M Gray
*Assistant Examiner* — Erika Villaluna
(74) *Attorney, Agent, or Firm* — Nixon & Vanderhye, PC

(57) ABSTRACT

A developing unit for developing an electrostatic latent image formed on the outer peripheral surface of a latent image bearer rotating in one direction utilizes an electrified developer that is prepared by mixing two components, or an electrostatically chargeable toner and magnetic carrier. The developing unit includes a developing roller for supplying the developer to the latent image bearer and a carrier collecting roller disposed on the downstream side of the developing roller with respect to the rotational direction of the latent image bearer. The carrier collecting roller includes first and second magnetic pole elements of different magnetic polarities, both presenting a magnetic field intensity of 400 G to 750 G. The first magnetic pole element is disposed at a position on the opposite side across the center of the carrier collecting roller from the position opposing the latent image bearer. The second magnetic pole element is disposed at a position opposing the developing roller.

16 Claims, 16 Drawing Sheets

FIG. 7

| Magnetic field intensity | None | 285G | 427G | 452G | 589G | 658G | 734G | 893G |
|---|---|---|---|---|---|---|---|---|
| Magnetic pole effective angle | | 46° | 41° | 40° | 40° | 38° | 44° | 43° |
| Leakage magnetic field intensity | - | 6G | 35G | 39G | 49G | 51G | 60G | 72G |
| Leakage magnetic field effective angle | | None | 47° | 50° | 50° | 47° | 48° | 49° |
| Carrier decrement after 500 k with processing speed set at 360 mm/sec | 21g | 7.4g | 2.2g | 2.2g | 1.7g | 1.5g | 1.4g | 4.2g |
| Image evaluation | × | △ | ○ | ○ | ○ | ○ | ○ | △ |
| Carrier decrement after 500 k with processing speed set at 540 mm/sec | 24g | 5.2g | 1.5g | 1.3g | 0.9g | 0.9g | 0.9g | 3.5g |
| Image evaluation | × | △ | ○ | ○ | ○ | ○ | ○ | △ |
| Carrier decrement after 500 k with processing speed set at 250 mm/sec | 20g | 18g | 12g | 11g | 7.8g | 7.2g | 4.1g | 4.5g |
| Image evaluation | × | × | × | × | △ | △ | △ | △ |

FIG. 8

The relationship between the magnetic poles and magnetic intensities of the magnet roller provided for the developing roller

| Magnetic pole | N1 | S1 | N2 | S2 | N3 | N4 | S3 |
|---|---|---|---|---|---|---|---|
| Magnetic intensity (G) | 1226 | 1018 | 358 | 623 | 483 | 496 | 924 |

| | N10 | S10 | Angle bet. N10-S10 | Angle bet. N10- Drum closest point |
|---|---|---|---|---|
| Peak value | 285 | -317 | - | - |
| Angle | 270.00 | 360 | 70.00 | 133.23 |
| Half value width | 32.85 | 30.90 | - | - |

| | N10 | S10 | Angle bet. N10-S10 | Angle bet. N10- Drum closest point |
|---|---|---|---|---|
| Peak value | 427 | -428 | - | - |
| Angle | 259.10 | 360 | 100.1 | 163.74 |
| Half value width | 27.05 | 28.80 | - | - |

| | N10 | S10 | Angle bet. N10-S10 | Angle bet. N10- Drum closest point |
|---|---|---|---|---|
| Peak value | 452 | -433 | - | - |
| Angle | 260.58 | 360 | 99.42 | 160.10 |
| Half value width | 26.00 | 27.73 | - | - |

| | N10 | S10 | Angle bet. N10-S10 | Angle bet. N10- Drum closest point |
|---|---|---|---|---|
| Peak value | 589 | -580 | - | - |
| Angle | 261.30 | 360 | 98.7 | 160.83 |
| Half value width | 27.08 | 27.65 | - | - |

| | N10 | S10 | Angle bet. N10-S10 | Angle bet. N10- Drum closest point |
|---|---|---|---|---|
| Peak value | 658 | -650 | - | - |
| Angle | 219.3 | 360 | 140.7 | 149.29 |
| Half value width | 24.95 | 25.25 | - | - |

| | N10 | S10 | Angle bet. N10-S10 | Angle bet. N10- Drum closest point |
|---|---|---|---|---|
| Peak value | 734 | -725 | - | - |
| Angle | 256.55 | 360 | 103.45 | 169.10 |
| Half value width | 27.85 | 27.98 | - | - |

| | N10 | S10 | Angle bet. N10-S10 | Angle bet. N10- Drum closest point |
|---|---|---|---|---|
| Peak value | 893 | -885 | - | - |
| Angle | 257.46 | 360 | 102.54 | 165.34 |
| Half value width | 31.21 | 30.52 | - | - |

| | N10 | S10 | Angle bet. N10-S10 | Angle bet. N10- Drum closest point |
|---|---|---|---|---|
| Peak value | 297 | -298 | - | - |
| Angle | 308.23 | 360 | 51.77 | 114.25 |
| Half value width | 33.40 | 23.85 | - | - |

| | N10 | S10 | Angle bet. N10-S10 | Angle bet. N10- Drum closest point |
|---|---|---|---|---|
| Peak value | 292 | -323 | - | - |
| Angle | 297.17 | 360 | 62.83 | 128.04 |
| Half value width | 27.02 | 28.98 | - | - |

DEVELOPING UNIT AND IMAGE FORMING APPARATUS USING THE SAME

This Nonprovisional application claims priority under 35 U.S.C. §119 (a) on Patent Application No. 2007-15121 filed in Japan on 25 Jan. 2007, the entire contents of which are hereby incorporated by reference.

BACKGROUND OF THE TECHNOLOGY

1. Field of the Technology

The technology relates to a developing unit used in an image forming apparatus such as a copier, printer, facsimile machine or the like using electrophotography as well as relating to an image forming apparatus including this developing unit. The technology in particular relates to a carrier collecting roller provided for a developing unit in a high-speed processing image forming apparatus.

2. Description of the Prior Art

Recent image forming apparatuses such as copiers, facsimile machines, printers, so-called multifunctional machines having these functions use a dual-component developing process using a dual-component developer consisting of a toner and a magnetic carrier. The dual-component developing process is an image forming process for performing image formation by electrostatically adhering the toner that has been tribo-electrified by the magnetic carrier to the electrostatic latent image formed on the photoreceptor.

The magnetic carrier used in the dual-component developing process has a function of forming a magnetic brush by charging the toner by electrifying itself with the opposite polarity to that on the toner so as to form a magnetic brush to thereby perform development. Usually, this carrier itself will not adhere to the photoreceptor.

However, since the carrier is charged with the opposite polarity to that on the toner, there have been cases where the carrier adheres to the background area and areas other than the background but having higher potentials than the latent image potential levels. Once the carrier adheres to the photoreceptor, the carrier lowers the transfer medium's adhesion to the photoreceptor during transfer, inducing transfer image degradation such as white voids and the like.

The leftover toner remaining on the photoreceptor surface after transfer of the toner image is usually removed by a cleaning member of a cleaning unit so as to clean the photoreceptor drum surface. However, if the carrier remains on the photoreceptor surface during the cleaning, there is a fear that the carrier damages or scratches the photoreceptor and induces degradation of the cleaning member, hence shorten the lives of these components.

In the field of image forming apparatuses, there is a trend toward high speed and high resolution. To achieve this, the carrier is demanded to be smaller in size. However, as the carrier becomes smaller in size, the carrier becomes liable to adhere to the photoreceptor during development. In addition, the enhancement of the speed of printing in the image forming apparatus means increase in the rotational speed of the photoreceptor drum, and this has caused difficulties in collecting and conveying the carrier from photoreceptor drum. To deal with this, there are many developing unit configurations that include a carrier collecting roller arranged on the downstream side of the developing roller.

As one example of a developing unit that facilitates collection of the carrier from the photoreceptor drum by using such a carrier collecting roller has been disclosed in Japanese Patent Application Laid-open 2006-215402 (patent document 1).

That is, patent document 1 discloses an image forming apparatus using a developing unit that develops the electrostatic latent image formed on the photoreceptor by forming a magnetic brush of a developer consisting of a carrier and a toner on a developing roller that includes fixed magnets therein. In this image forming apparatus, a magnetized carrier collecting roller is arranged downstream of the developing roller while a magnet is laid out at a position opposing this carrier collecting roller inside the photoreceptor so that this magnet forms a magnetic field that is parallel with the tangent direction of the outer periphery of the photoreceptor. In this image forming apparatus, penetration of the carrier into the transfer device is prevented by attracting the developer that has come along the photoreceptor from the developing area to the carrier collecting roller by the effect of the magnetic field formed by the magnets disposed inside the photoreceptor and in the carrier collecting roller, to thereby prevent occurrence of white voids in the image and damage to the photoreceptor.

In this case, the developing unit disclosed in patent document 1, the magnetic poles of the magnet of the carrier collecting roller are disposed so as to oppose the photoreceptor. That is, the magnetic field created by the magnet disposed inside the photoreceptor and the magnet in the carrier collecting roller attracts surplus developer to the carrier collecting roller, to thereby prevent occurrence of white voids in the image and damage to the photoreceptor. However, this disclosure includes no reference to the effect as to whether the carrier can be collected efficiently even when the photoreceptor rotates at high speed and has not yet reached smooth conveyance and recollection of the collected carrier.

SUMMARY OF THE TECHNOLOGY

The technology has been devised in view of the above problems entailed with the conventional developing units, it is therefore an object to provide a new and improved developing unit and image forming apparatus which can efficiently collect and convey adhering carrier even when a small-sized carrier is used in a high-speed processing machine.

In order to solve the above problem, one aspect of the present technology provides a developing unit for developing an electrostatic latent image formed on the outer peripheral surface of a latent image bearer rotating in one direction with an electrified developer that is prepared by mixing two components, or an electrostatically chargeable toner and magnetic carrier, comprising: a developing roller formed of a magnet roller incorporating a plurality of fixed magnetic pole elements and a cylindrical sleeve that rotates relative to the magnet roller for supplying the developer to the latent image bearer, by attracting the developer on the surface of the rotating cylindrical sleeve; and a carrier collecting roller disposed on the downstream side of the developing roller with respect to the rotational direction of the latent image bearer, characterized in that the carrier collecting roller includes first and second magnetic pole elements having different magnetic polarities, both presenting a magnetic field intensity of 400 G to 750 G; the first magnetic pole element is disposed at a position on the opposite side across the center of the carrier collecting roller from the position opposing the latent image bearer; and the second magnetic pole element is disposed at a position opposing the developing roller.

Taking the above configuration instead of arranging the magnetic pole elements in the carrier collecting roller at a position opposing the latent image bearer or a photoreceptor drum, can produce a leakage magnetic field having a high enough magnetic field intensity of about 35 G to 80 G to collect the carrier, hence makes it possible to collect the carrier using this magnetic field.

Further, though the magnetic field produced by the conventional magnetic element is unidirectional and presents a narrow effective width to collect the carrier, the arrangement of the technology can produce a leakage magnetic field which spreads over a wide range along the outer peripheral surface of the carrier collecting roller and is oriented in multi-directions so that the leakage magnetic field is strong enough to collect the carrier. Accordingly, it is possible to collect the carrier efficiently even from the photoreceptor drum that rotates at high speed.

Further, since the leakage magnetic field is oriented multi-directionally in a wide range so that the distance between the neighboring magnetic poles in effect becomes shorter, this improves conveyance of the collected carrier.

In the above configuration, it is preferable that the angle formed between the first and second magnetic pole elements is equal to or greater than 80°. It is also preferable that the angle formed between the first magnetic pole element and the closest center line from the center of the carrier collecting roller to the closest point on the carrier collecting roller that is located closest to the latent image bearer is equal to or greater than 140°.

This arrangement of the magnetic pole elements enables generation of a leakage magnetic field that presents strong enough magnetic intensity to collect the carrier over a wide effective angle along the outer peripheral surface of the carrier collecting roller on the opposite side from the magnetic pole element. As a result it is possible to efficiently collect the adhering carrier even if the image forming apparatus is a high-speed processing machine using a small-sized carrier.

In the above configuration, the peripheral velocity of the latent image bearer may be equal to or greater than 360 mm/sec.

Though the carrier scatters off the photoreceptor drum when the peripheral velocity of the photoreceptor is equal to or greater than 360 mm/sec, the above configuration makes it possible to attract and collect the carrier to the magnetic poles of the carrier collecting roller that do not oppose the photoreceptor drum. Further, the carrier remaining on the photoreceptor drum can be collected by the leakage magnetic field of the carrier collecting roller.

In the above configuration, a scraper member may be provided contacting the outer peripheral surface of the carrier collecting roller on the downstream side with respect to the rotational direction of the carrier collecting roller to scrape wastes adhering on the outer peripheral surface.

With this configuration, toner, toner additives and other wastes adhering on the carrier collecting roller can be removed by the scraper member, so that the outer peripheral surface of the carrier roller can be cleaned.

In the above configuration, the tip end of the scraper may be adapted to abut the outer peripheral surface of the carrier collecting roller at the position where the magnetic force perpendicular to the outer peripheral surface is weakest.

This configuration makes it possible to efficiently remove toner, toner additives and other wastes adhering on the outer peripheral surface of the carrier collecting roller by the scraping member.

In the above configuration, it is preferable that, of the fixed magnetic pole elements included in the magnet roller, one that is located closest to the carrier collecting roller and the magnetic pole element that belongs to the carrier collecting roller and is located closest to the fixed magnetic pole element that is located closest to the carrier collecting roller have the same magnetic polarity.

This configuration enables smooth collection of the carrier adhering on photoreceptor drum.

In order to achieve the above object, an image forming apparatus including any one of the above developing units is advantageous.

With this configuration, the developing unit can efficiently collect the adhering carrier and convey it even if the image forming apparatus is a high-speed processing machine using a small-sized carrier. Accordingly, it is possible to suppress the carrier from lowering of the adhesion of the printing material to the photoreceptor drum during transfer and from degrading the transferred image with so-called white voids and the like, which would occur if the carrier adheres to the photoreceptor drum.

As has been described heretofore, it is possible to widen the effective angle of the magnetic field in which strong enough magnetic force to collect the carrier adhering on the photoreceptor drum can be secured, it is hence possible to efficiently collect the carrier adhering on the photoreceptor drum even if the photoreceptor drum rotates at high speed. Further, since the distance between the neighboring magnetic poles in the carrier collecting roller in effect becomes shorter, this enables smooth conveyance and recollection of the collected carrier.

BRIEF DESCRIPTION OF THE DRAWINGS

FIG. 7 is a table for representing the evaluation of the effects in accordance with the setup conditions of the magnetic pole elements provided for the carrier collecting roller in example 1 of the developing unit of the same embodiment;

FIG. 8 is a table showing the relationships between the magnetic intensities and the magnetic poles of the magnet roller in the developing roller of example 1 of the developing unit of the same embodiment;

DESCRIPTION OF THE PREFERRED EMBODIMENTS

Figure 1:
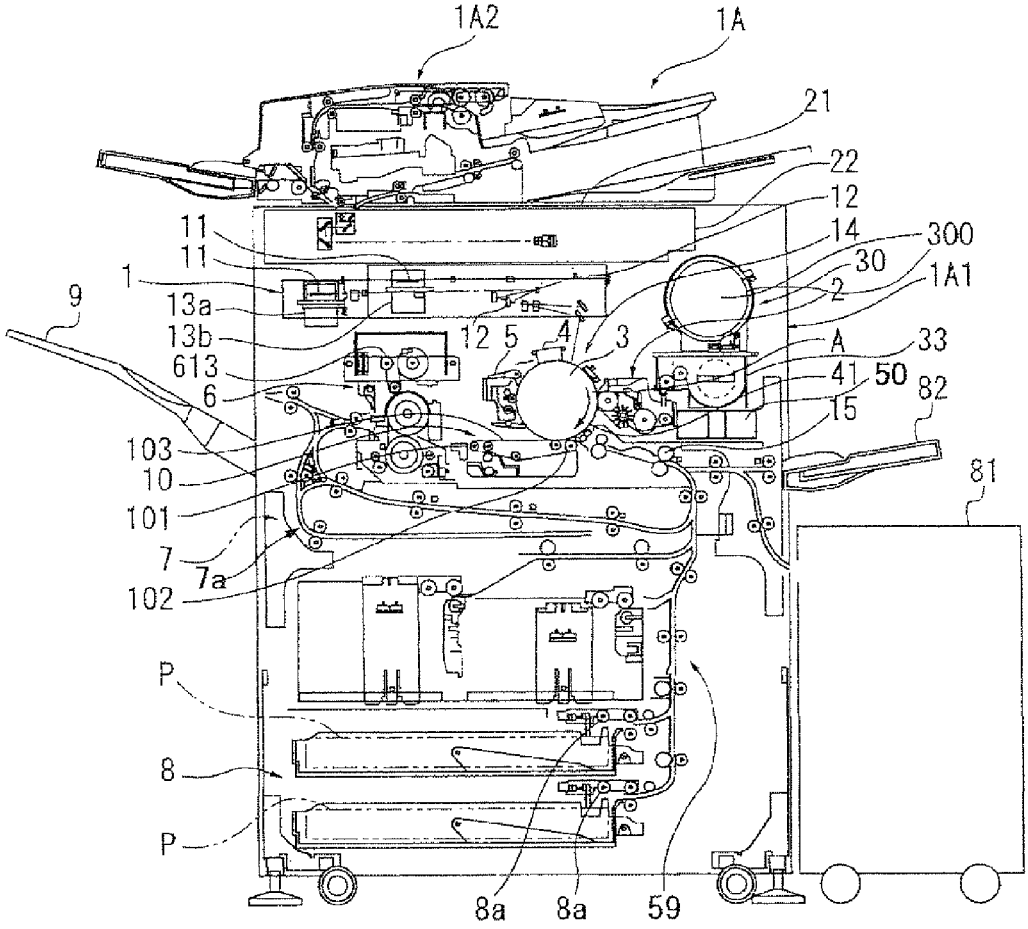
FIG. 1 is an illustrative view showing an overall configuration of an image forming apparatus according to the first embodiment in which a developing unit is used.

The preferred embodiment will hereinafter be described with reference to the accompanying drawings. In the specification and drawings herein, components having substantially the same functions and configurations are allotted with the same reference numerals so that repeated description is omitted.

Figure 2:
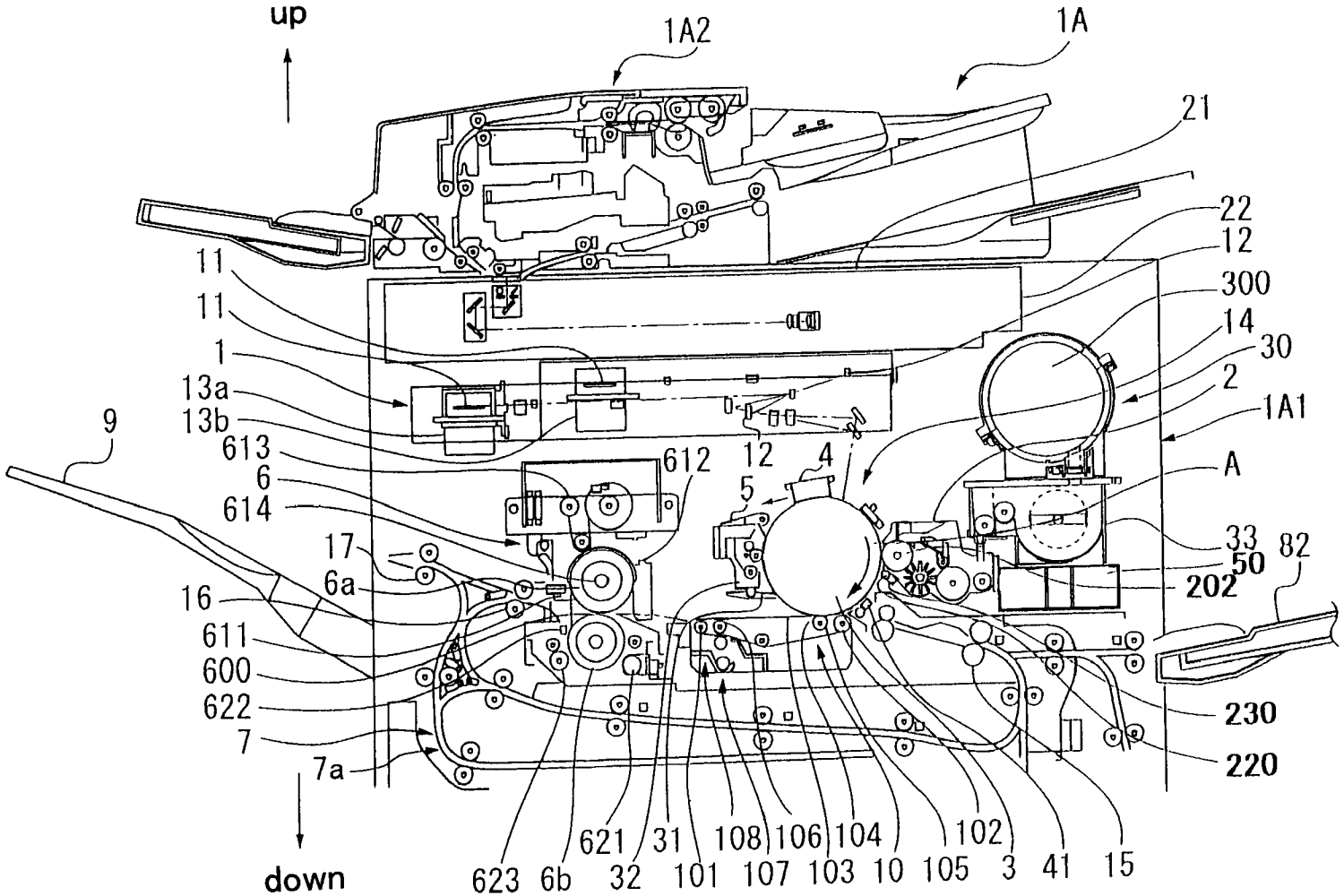
FIG. 2 is a partial detailed view showing a configuration of the apparatus body of the image forming apparatus of the same embodiment.

To being with, the configuration of the first embodiment of an image forming apparatus in which a developing unit is used will be described with reference to the drawings. FIG. 1 is an illustrative view showing an overall configuration of the first embodiment of an image forming apparatus in which a developing unit is used. FIG. 2 is a partial detailed view showing the configuration of the apparatus body of the same image forming apparatus.

As shown in FIGS. 1 and 2 an image forming apparatus 1A according to the present embodiment is an image forming apparatus that processes image data captured by a scanner etc., or image data transmitted from without to output a monochrome (single color) image, based on the electrophotography, by forming an electrostatic latent image on a rotationally driven, cylindrical photoreceptor drum (latent image bearer) 3, developing the electrostatic latent image into a visualized developer image with an electrified developer prepared by mixing two components, or an electrostatically chargeable toner and magnetic carrier, and transferring the developed image to a predetermined sheet of recording paper (to be referred to as paper hereinbelow) as a recording medium. This image forming apparatus 1A adopts, as its developing device for visualizing the electrostatic latent image on photoreceptor drum 3, a developing unit 2, which is distinctive in this technology, including a carrier collecting roller 220 (FIG. 2) for collecting the magnetic carrier having adhered on photoreceptor drum 3 and a carrier removing device 230 (FIG. 2) for removing the magnetic carrier collected by carrier collecting roller 220 therefrom.

This image forming apparatus 1A includes a paper feed tray 8 which can stack multiple sheets of paper P (FIG. 1) thereon; a paper conveying portion 59 for conveying paper P fed from this paper feed tray 8 to an image forming portion 14; and a paper conveyor system 7 for conveying the paper P with an unfixed toner image printed thereon by image forming portion 14 to a fixing unit 6 where the unfixed toner is fused and fixed onto the paper. The image forming apparatus, based on the conveying speeds of paper P corresponding to a multiple number of preset printout processing modes, can select and control the conveying speed of paper P in accordance with a print request and automatically convey paper P from paper feed tray 8 to a paper output tray 9.

First, the overall configuration of image forming apparatus 1A will be described. Image forming apparatus 1A is essentially composed of, as shown in FIG. 1, an apparatus body 1A1 including a light exposure unit 1, developing unit 2, a toner feed device 30, photoreceptor drum 3, a charger 4, a charge erasing device 41, a cleaner unit 5, a fixing unit 6, paper conveyor system 7, a paper feed path 7*a*, paper feed tray 8, paper output tray 9, a transfer device 10 and the like, and an automatic document processor 1A2.

Formed on the top surface of apparatus body 1A1 is an original placement table 21 made of transparent glass on which a document is placed. Automatic document processor 1A2 is arranged on the top of this original placement table 21 so that it can pivotally open upwards, while a scanner portion 22 as a document reader for reading image information of originals is arranged under this original placement table 21.

Arranged below scanner portion 22 are light exposure unit 1, developing unit 2, photoreceptor drum 3, charger 4, charge erasing device 41, cleaner unit 5, fixing unit 6, paper conveyor system 7, paper feed path 7*a*, paper output tray 9 and transfer device 10. Further, paper feed tray 8 that accommodates paper P therein is arranged under these.

Light exposure unit 1 provides a function of emitting laser beam in accordance with the image data output from an unillustrated image processor to irradiate the photoreceptor drum 3 surface that has been uniformly electrified by charger 4 so as to write and form an electrostatic latent image corresponding to the image data on the photoreceptor drum 3 surface. This light exposure unit 1 is arranged directly under scanner portion 22 and above photoreceptor drum 3, and includes laser scanning units (LSUs) 13*a* and 13*b* including laser emitters 11 and a reflection mirror 12. In the present embodiment, in order to achieve high-speed printing operation, multiple laser beams from multiple laser emitters 11 are used to reduce the irradiation frequency of each laser beam (the processing load of each laser beam per unit time is reduced). More specifically, a two-beam technique using a pair of laser emitters 11 to emit two laser beams is adopted. Here, in the present embodiment laser scanning units (LSUs) 13*a* and 13*b* are used for light exposure unit 1, but an array of light emitting elements, e.g., an EL (electroluminescence) or LED (light-emitting diode) writing head may also be used.

Photoreceptor drum 3 has an approximately cylindrical shape, is arranged under light exposure unit 1 and is controlled so as to rotate in a predetermined direction (in the direction of arrow A in the drawing) by an unillustrated drive means and control means. Arranged along the peripheral surface of this photoreceptor drum 3, starting from the position at which image transfer ends downstream in the rotational direction of the photoreceptor drum are, as shown in FIG. 2, a paper separation claw 31, cleaner unit 5, charger 4 as an electric field generator, developing unit 2 and charge erasing device 41 in the order mentioned.

Paper separation claw 31 is disposed so as to be moved into and out of contact with the outer peripheral surface of photoreceptor drum 3 by means of a solenoid 32. When this paper separation claw 31 is put in abutment with the outer peripheral surface of photoreceptor drum 3, it functions to peel off the paper P that has adhered to the photoreceptor drum 3 surface during the unfixed toner image on photoreceptor drum 3 being transferred to the paper P. Here, as a driver for paper separation claw 31, a drive motor or the like may be used instead of solenoid 32, or any other driver may also be selected.

Developing unit 2 visualizes the electrostatic latent image formed on photoreceptor drum 3 with black toner, and is arranged at approximately the same level at the side (on the right side in the drawing) of photoreceptor drum 3 downstream of charger 4 with respect to the rotational direction of the photoreceptor drum (in the direction of arrow A in the drawing). A registration roller 15 is disposed under this developing unit 2 on the upstream side with respect to the recording medium's direction of conveyance. This developing unit 2 will be detailed later.

Carrier collecting roller 220 is arranged under developing unit 2 to collect magnetic carrier particles adhering on photoreceptor drum 3. Carrier removing device 230 has a function of removing magnetic carrier collected by carrier collecting roller 220 from carrier collecting roller 220. This carrier collecting roller 220 of the present embodiment will be described later.

Toner feed device 30 temporarily holds the toner discharged from a toner container 300 filled with toner, in an intermediate hopper 33 and then supplies it to developing unit 2. This toner feed device is arranged adjacent to developing unit 2. Arranged under this toner feed device 30 is a duct unit 50 for sending air to a developing vessel 200 of developing unit 2 in order to forcibly cool or remove operational heat that arises while developing unit 2 is operated.

Registration roller 15 is operated and controlled by an unillustrated driver and controller so as to convey the paper P delivered from paper feed tray 8 into and between photoreceptor drum 3 and a transfer belt 103 whilst making the leading end of the paper P register with the toner image on the photoreceptor drum 3.

Charger 4 is a charging device for uniformly charging the photoreceptor drum 3 surface at a predetermined potential, and is arranged over photoreceptor drum 3 and close to the outer peripheral surface thereof. Here, a discharge type charger 4 is used in the present embodiment, but a contact roller type or a brush type may be used instead.

Charge erasing device 41 is a pre-transfer erasing device for lowering the surface potential of the photoreceptor drum 3 in order to facilitate the toner image formed on the photoreceptor drum 3 surface to transfer to paper P, and is laid out on the downstream side of developing unit 2 with respect to the photoreceptor drum's direction of rotation and under photoreceptor drum 3 and close to the outer peripheral surface of the same. Though in the present embodiment, charge erasing device 41 is configured using a charge erasing electrode, a charge erasing lamp or any other technique can be used instead of the charge erasing electrode.

Cleaner unit 5 removes and collects the toner left on the surface of photoreceptor drum 3 after development and image transfer, and is disposed at approximately the same level at the side of photoreceptor drum 3 (on the left side in the drawing), on the approximately opposite side across photoreceptor drum 3 from developing unit 2.

As described above, the visualized electrostatic image on photoreceptor drum 3 is transferred to the paper P being conveyed whilst the paper is being applied by transfer device 10 with an electric field having an opposite polarity to that of the electric charge of the electrostatic image. For example, when the electrostatic image bears negative (−) charge, the applied polarity of transfer device 10 should be positive (+).

Transfer device 10 is provided as a transfer belt unit in which transfer belt 103 having a predetermined resistivity (ranging from $1\times10^{9}$ to $1\times10^{13}$ Ω·cm in the embodiment) is wound and tensioned on a drive roller 101, a driven roller 102 and other rollers, and is disposed under photoreceptor drum 3 with the transfer belt 103 surface put in contact with part of the outer peripheral surface of photoreceptor drum 3. This transfer belt 103 conveys paper P while pressing the paper against photoreceptor drum 3. An elastic conductive roller 105 having a conductivity different from that of drive roller 101 and driven roller 102 and capable of applying a transfer electric field is laid out at a contact point 104 where transfer belt 103 comes into contact with photoreceptor drum 3.

Elastic conductive roller 105 is composed of a soft material such as elastic rubber, foamed resin etc. Since this elasticity of elastic conductive roller 105 permits photoreceptor drum 3 and transfer belt 103 to come into, not line contact, but area contact of a predetermined width (called a transfer nip) with each other, it is possible to improve the efficiency of transfer to the paper P being conveyed.

Further, a charge erasing roller 106 for erasing the electric field that has been applied to the paper P whilst being conveyed through the transfer area so as to achieve smooth conveyance of the paper to the subsequent stage is disposed on the interior side of transfer belt 103, on the downstream side, with respect to the direction of paper conveyance, of the transfer area of transfer belt 103.

As shown in FIG. 2, transfer device 10 also includes a cleaning unit 107 for removing dirt due to leftover toner on transfer belt 103 and a plurality of charge erasing devices 108 for erasing electricity on transfer belt 103. Erasure of charge by erasing devices 108 may be performed by grounding via the apparatus or by positively applying charge of a polarity opposite to that of the transfer field.

The paper P with the static image (unfixed toner) transferred thereon by transfer device 10 is conveyed to fixing unit 6, where it is pressed and heated so as to fuse the unfixed toner and fix it to the paper P. This fixing unit 6 includes a heat roller 6*a* and a pressing roller 6*b* as shown in FIG. 2 and fuses and fixes the toner image transferred on paper P by rotating heat roller 6*a* so as to convey the paper P held between heat roller 6*a* and pressing roller 6*b* through the nip therebetween. Arranged on the downstream side of fixing unit 6 with respect to the direction of paper feed is a conveyance roller 16 for conveying paper P. Also, a paper discharge roller 17 for discharging paper P to paper output tray 9 is arranged on the downstream side of this conveyance roller 16 with respect to the direction of paper feed.

Heat roller 6*a* has a sheet separation claw 611, a thermistor 612 as a roller surface temperature detector and a roller surface cleaning member 613, all arranged on the outer periphery thereof and also includes a heat source 614 for heating the heat roller surface at a predetermined temperature (set fixing temperature: approximately 160 to 200 deg. C.) in the interior part thereof.

Pressing roller 6*b* is provided at its each end with a pressing element 621 that is capable of pressing the pressing roller 6*b* with a predetermined pressure against heat roller 6*a*. In addition a sheet separation claw 622 and a roller surface cleaning element 623 are provided on the outer periphery of pressing roller 6*b*, similarly to the outer periphery of heat roller 6*a*.

In this fixing unit 6, as shown in FIG. 2 the unfixed toner on the paper P being conveyed is heated and fused by heat roller 6*a*, at the pressed contact (so-called fixing nip portion) 600 between heat roller 6*a* and pressing roller 6*b*, so that the unfixed toner is fixed to the paper P by the anchoring effect to the paper P by the pressing force from heat roller 6*a* and pressing roller 6*b*.

As shown in FIG. 1, paper feed tray 8 stacks a plurality of sheets (paper) to which image information will be output (printed), and is arranged under image forming portion 14 made up of light exposure unit 1, developing unit 2, photoreceptor drum 3, charger 4, charge erasing device 41, cleaner unit 5, fixing unit 6 etc. A paper pickup roller 8*a* is disposed at an upper part on the paper output side of this paper feed tray 8.

This paper pickup roller 8*a* picks up paper P, sheet by sheet, from the topmost of a stack of paper stored in paper feed tray 8, and conveys the paper downstream (for convenience' sake, the paper P's starting side (the cassette side) is referred to as upstream and the paper output side is referred to as downstream) to the registration roller (also called "idle roller") 15 side in paper feed path 7*a*.

Since the image forming apparatus 1A according to the present embodiment is aimed at performing high-speed printing operations, a multiple number of paper feed trays 8 each capable of stacking 500 to 1500 sheets of standard-sized paper P are arranged under image forming portion 14. Further, a large-capacity paper feed cassette 81 capable of storing multiple kinds of paper in large volumes is arranged at the side of the apparatus while a manual feed tray 82 for essentially supporting printing etc. for irregular sized paper is arranged over the large-capacity paper feed cassette 81.

Paper output tray 9 is arranged on the opposite side across the apparatus from that of manual feed tray 82. It is also possible to configure such a system that instead of paper output tray 9, a post-processing machine for stapling, punching of output paper and the like and/or a multi-bin paper output tray etc., may be arranged as an option.

Paper conveyor system 7 is laid out between the aforementioned photoreceptor drum 3 and paper feed tray 8, and conveys paper P supplied from paper feed tray 8, sheet by sheet, by way of paper feed path 7*a* provided for paper conveyor system 7, to transfer device 10, where a toner image is transferred from photoreceptor drum 3 to the paper, further conveying it to fixing unit 6 where the unfixed toner image is fixed to the paper, then conveys the sheet as it is being guided by paper feed paths and branch guides, in accordance with the designated paper output processing mode.

In the image forming apparatus 1A according to the present embodiment, as the predetermined output processing modes, one-sided printing mode and two-sided printing mode are prepared. In one-sided printing mode, there are two ways of paper output, i.e., the faceup output by which the paper is discharged with its printed surface faceup and the facedown output by which the paper is discharged with its printed surface facedown.

Figure 3:
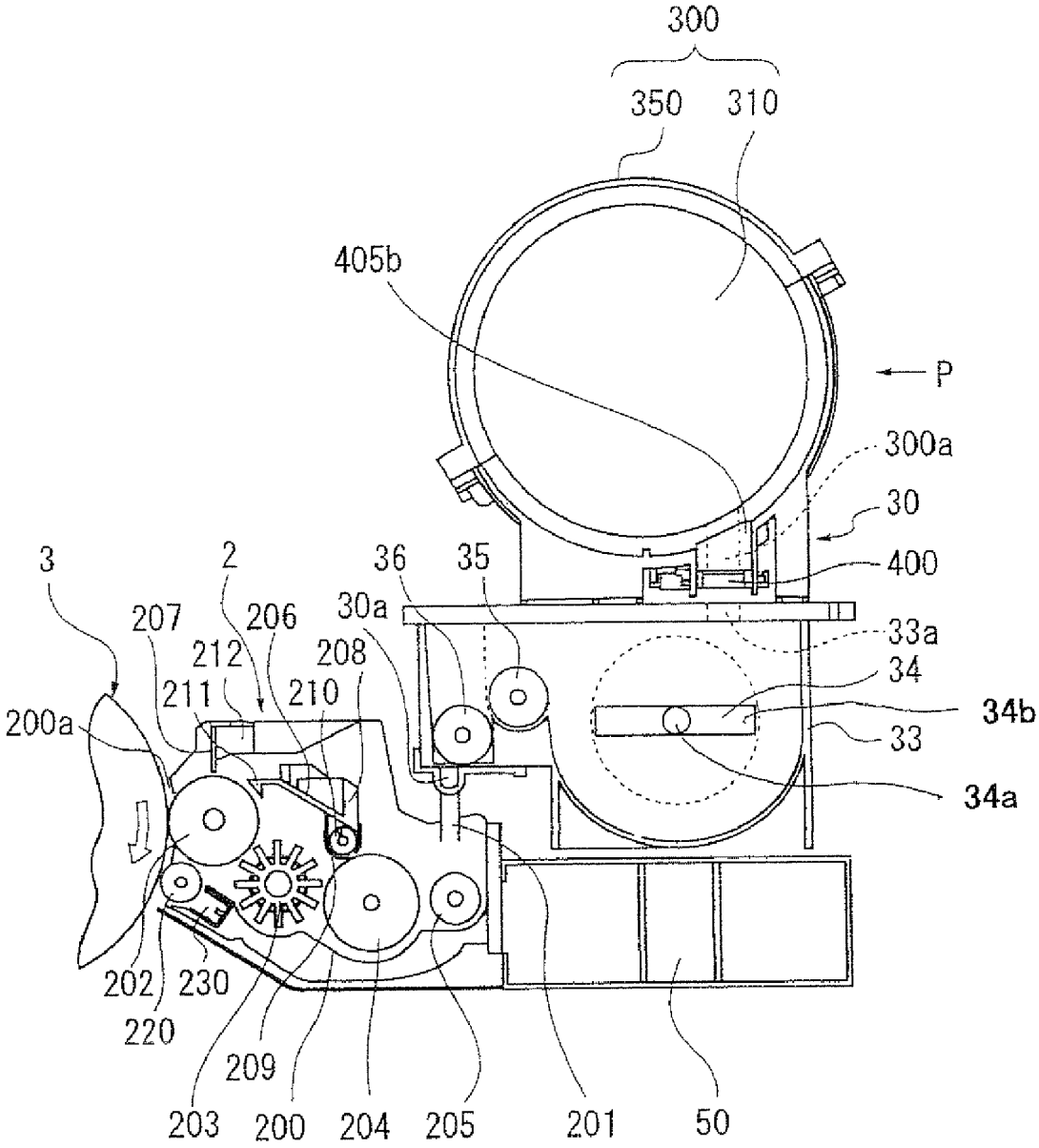
FIG. 3 is a schematic configurational view showing a developing unit and toner feed device that are provided in the image forming apparatus of the same embodiment.

Next, developing unit 2 and its peripheral components that constitute image forming apparatus 1A according to the present embodiment will be described with reference to the drawings. FIG. 3 is a schematic configurational side view showing the developing unit and toner feed device that are included in the image forming apparatus according to the present embodiment.

In this embodiment, as shown in FIG. 3, toner feed device 30 is arranged adjacent to developing unit 2. Duct unit 50 for sending air to a developing vessel 200 that forms the exterior of developing unit 2 is provided under this toner feed device 30 in order to forcibly remove heat arising during the operation of developing unit 2.

As shown in FIG. 3, in developing unit 2 a toner input port 201 for leading toner is formed at a position where the developing vessel 200 that forms its exterior abuts opening 30*a* for supplying toner from toner feed device 30. This developing vessel 200 incorporates developer roller 202, a paddle roller 203, a mixing roller 204, a conveying roller 205, a partitioning plate 206 and a regulating member 207. Developing unit 2 is mounted inside image forming apparatus 1A in such a manner that the peripheral surface (the developer adhering on the peripheral area) of developing roller 202 opposes in contact with the peripheral surface of photoreceptor drum 3. That is, the peripheral surface area of developing roller 202 opposing in contact with photoreceptor drum 3 forms the developing position. Further, arranged adjacent to and under developing roller 202 in the opening, designated at 200*a* of developing vessel 200 is carrier removing device 230 including carrier collecting roller 220 for collecting the carrier adhering on photoreceptor drum 3.

In developing vessel 200, the toner that was fed from toner feed device 30 and input through toner input port 201 is conveyed by conveying roller 205 to mixing roller 204, where the toner is mixed with magnetic carrier to thereby prepare a dual-component developer. Mixing roller 204 mixes this newly formed dual-component developer with the surplus developer that is returned by the aforementioned partitioning plate 206. The developer thus obtained by mixing with mixing roller 204 is tribo-electrified as it is agitated by paddle roller 203, then supplied to developing roller 202 for developing electrostatic latent images and further conveyed to the electrostatic latent image carried on photoreceptor drum 3.

The developer supplied to developing roller 202 is first rubbed and pre-charged by a rubbing member 211 that is integrally formed at one end side of partitioning plate 206 whilst being regulated as to the amount of conveyance (layer thickness) thereby. Then, the layer thickness of the developer being conveyed by developing roller 202 is further controlled by regulating member 207 that is supported by a supporting member 212 as a part of developing vessel 200. In this way, the supplied amount of developer is regulated and the excluded, surplus developer is returned in directions going away from regulating member 207 by partitioning plate 206 that functions as a recirculating plate for returning surplus developer. These regulating member 207, rubbing member 211 and partitioning plate 206 are formed to be as long as developing roller 20.

Further, a plurality of rectifying plates 208 for distributing surplus of the developer in predetermined directions are formed on the upper side of partitioning plate 206 while a partitioning plate-side conveyor 209 which conveys surplus of the developer by a conveyor screw 210 is arranged on the lower side of partitioning plate 206. Details of these components provided in developing unit 2 will be described later.

Toner feed device 30 is arranged adjacent to developing unit 2, and temporarily reserves the toner discharged from toner container 300 filled with toner, in intermediate hopper 33 and then feeds the toner to developing unit 2. In the present embodiment, toner container 300 is configured so that its container body 310 charged with toner is rotatably supported by a supporting structure 350.

The toner thus sent out to intermediate hopper 33 is agitated therein by an agitator 34 first. Agitator 34 is comprised of an agitator shaft 34*a* and agitating vanes 34*b* attached thereto. As agitator shaft 34*a* turns, agitating vanes 34*b* rotate about agitator shaft 34*a* to thereby agitate the toner in intermediate hopper 33 that has been fed from toner container 300.

The toner thus agitated by agitator 34 is sent by the agitating action of agitator 34 and conveyed to the feed roller 36 side via a conveying roller 35. Feed roller 36 sends out the toner that has been conveyed from agitator 34 via conveying roller 35, to opening 30*a* that is formed at the position where intermediate hopper 33 abuts developing unit 2, to thereby supply the toner to developing unit 2.

Provided on the bottom side (the underside when toner container 300 is mounted on image forming apparatus 1A) of supporting structure 350 of toner container 300 is a shutter opening and closing mechanism 400 for opening and closing a toner feed aperture 300*a* through which toner supplied from toner container 300 is discharged out of supporting structure 350, as shown in FIG. 3. Specifically, as toner feed aperture 300*a* of supporting structure 350 is released by shutter opening and closing mechanism 400, passage between toner feed aperture 300*a* and opening 33*a* provided for intermediate hopper 33 is communicated, so that the toner discharged from toner container 300 is supplied to intermediate hopper 33.

Figure 4:
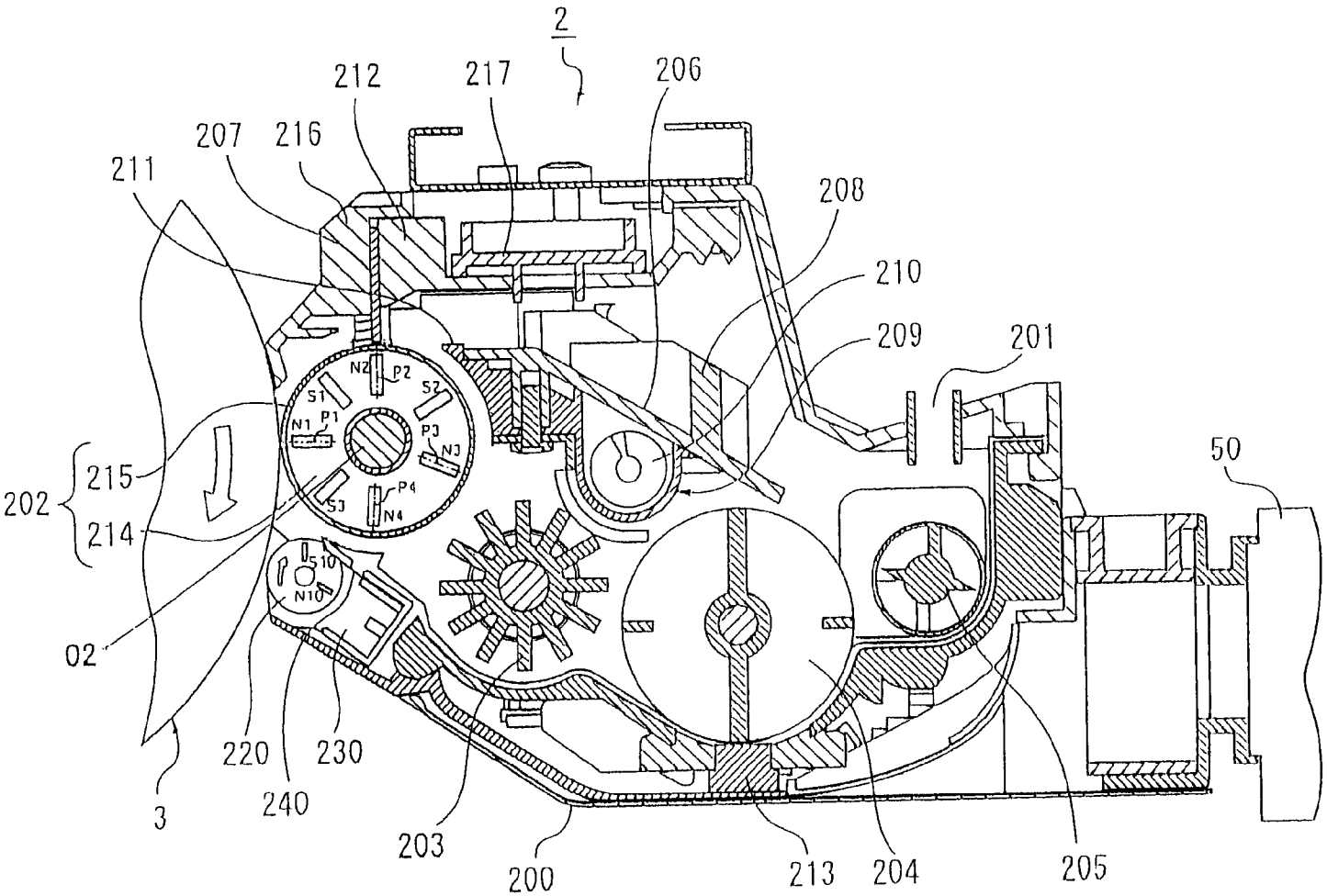
FIG. 4 is a sectional view showing the configuration of the developing unit of the same embodiment.
Figure 5A:
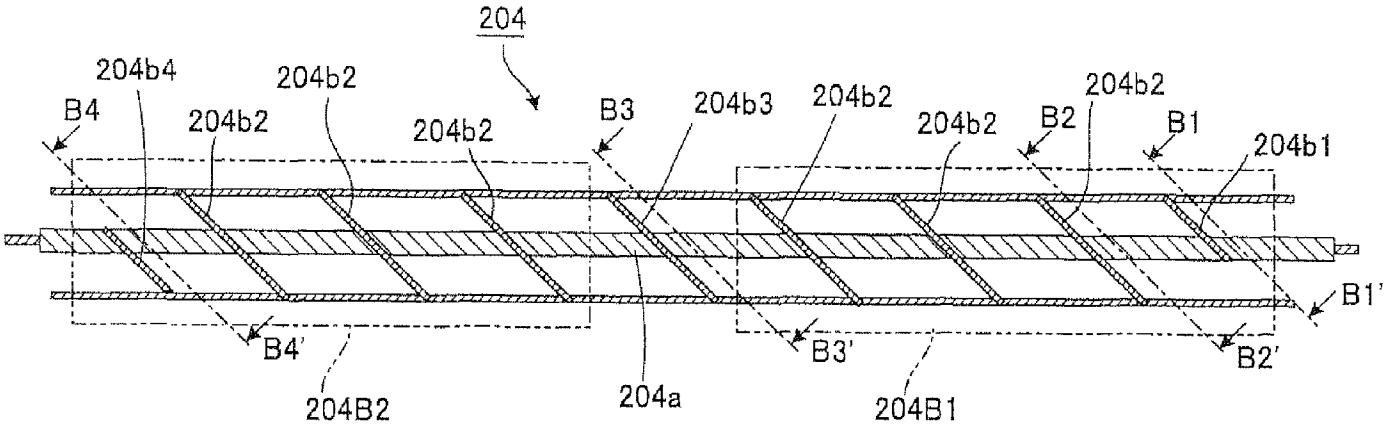
FIG. 5A is a sectional side view showing a configuration of a mixing roller that constitutes the developing unit of the same embodiment.
Figure 5B:
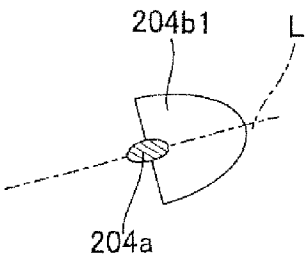
FIG. 5B is a sectional view cut along a plane B1-B1' in FIG. 5A.
Figure 5C:
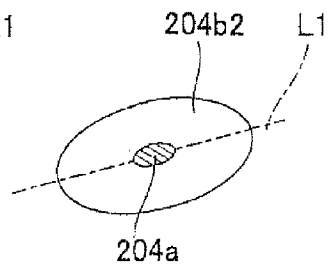
FIG. 5C is a sectional view cut along a plane B2-B2' in FIG. 5A.
Figure 5D:
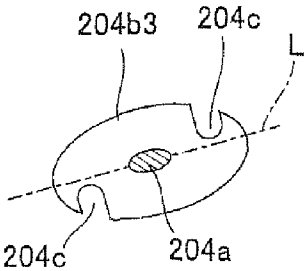
FIG. 5D is a sectional view cut along a plane B3-B3' in FIG. 5A.
Figure 5E:
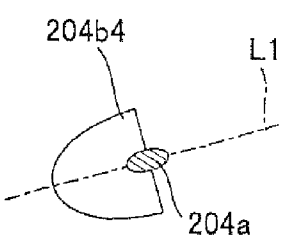
FIG. 5E is a sectional view cut along a plane B4-B4' in FIG. 5A.

Next, the characteristic configuration of developing unit 2 according to the present embodiment will be described in detail with reference to the drawings. FIG. 4 is a sectional view showing the configuration of the developing unit according to the present embodiment; FIG. 5A is a side sectional view showing a configuration of a mixing roller that constitutes the developing unit; FIG. 5B is a sectional view cut along a plane B1-B1' in FIG. 5A; FIG. 5C is a sectional view cut along a plane B2-B2' in FIG. 5A; FIG. 5D is a sectional view cut along a plane B3-B3' in FIG. 5A; and FIG. 5E is a sectional view cut along a plane B4-B4' in FIG. 5A.

As shown in FIG. 4, developing unit 2 includes developing vessel 200 forming its exterior, and toner input port 201 for leading toner is formed in this developing vessel 200 at a position where opening 30*a* (FIG. 3) provided for toner feed device 30 to deliver toner abuts the developing vessel 200. This developing vessel 200 reserves the developer therein and incorporates developer roller 202, paddle roller 203, mixing roller 204, conveying roller 205, a regulating member 207 and carrier collecting roller 220.

Developing unit 2 is mounted inside image forming apparatus 1A in such a manner that the peripheral surface (the developer adhering on the peripheral area) of developing roller 202 that is partly exposed from developing vessel 200 opposes in proximity to the peripheral surface of photoreceptor drum 3. That is, the peripheral surface area of developing roller 202 opposing photoreceptor drum 3 forms the developing position (developing area).

In developing vessel 200, the toner that was fed from toner feed device 30 (FIG. 3) and input through toner input port 201 is conveyed by conveying roller 205 to mixing roller 204, where the toner is mixed with the magnetic carrier to thereby prepare a dual-component developer. Mixing roller 204 mixes the aforementioned newly formed dual-component developer with the existing developer inside developing vessel 200. The developer obtained by mixing with mixing roller 204 is tribo-electrified as it is agitated by paddle roller 203, then supplied to developing roller 202 for developing electrostatic latent images, and conveyed by developing roller 202 to the electrostatic latent image formed on photoreceptor drum 3. The developer supplied to developing roller 202 and conveyed thereby is controlled as to its layer thickness by regulating member 207 that is supported by supporting member 212 as a part of developing vessel 200. In this way, the amount of developer to be supplied to photoreceptor drum 3 is regulated.

As a countermeasure against increase in temperature inside developing unit 2, in order to make the forced air-cooling by duct unit 50 more efficient, developing vessel 200 is made of a metallic material having a high thermal conductivity such as aluminum or the like and has opening 200*a* (FIG. 3) facing (opposing) the peripheral surface of photoreceptor drum 3.

Provided on the upper outside part of supporting member 212 that forms the top of developing vessel 200 is a pressure relief mechanism 217 for reducing the pressure inside developing vessel 200. This pressure relief mechanism 217 is periodically operated to release the pressure inside developing unit 2 so that toner scattering inside the apparatus can be prevented. Here, the attached position of pressure relief mechanism 217 is not limited to the top of developing vessel 200. For example, the mechanism may be arranged on the flank or at the bottom of developing vessel 200 as long as it can release the pressure inside developing vessel 200.

Developing roller 202 is arranged at the position inside developing vessel 200 facing (opposing) opening 200*a* (FIG. 3) while conveying roller 205 that conveys the developer (toner) supplied from toner input port 201 into developing vessel 200 to mixing roller 204 is disposed rotatably at a position that faces (opposes) toner input port 201.

A toner concentration sensor 213 for detecting the toner concentration inside developing vessel 200 is provided at the bottom opposing the lower side of mixing roller 204 in developing vessel 200. Image forming apparatus 1A is configured so as to supply toner from toner input port 201 based on the measurement of toner concentration sensor 213 when the amount of toner being mixed and agitated by mixing roller 204 becomes lower than the proper amount.

Arranged within opening 200*a* of developing vessel 200, adjacent to and below developing roller 202 is carrier collecting roller 220 for collecting the magnetic carrier that has adhered to photoreceptor drum 3. More specifically, carrier collecting roller 220 is arranged at a position downstream of developing roller 202 with respect to the rotational direction of photoreceptor drum 3 and positioned a small gap of about 1 mm apart from photoreceptor drum 3. Also, carrier removing device 230 which removes the magnetic carrier collected by this carrier collecting roller 220 therefrom is disposed at a position on the upstream side with respect to the rotational direction of the carrier collecting roller 220.

As shown in FIG. 4, developing roller 202 is arranged a development gap (about 0.5 to 1.5 mm) apart from photoreceptor drum 3. Developing roller 202 is formed of a magnet roller 214 with multiple magnetic poles and a non-magnetic sleeve 215 that is approximately cylindrically formed of an aluminum alloy, brass and the like and is arranged rotatably over, and relative to the magnet roller 214. In this magnetic roller 214, a plurality of bar magnets having rectangular sections, specifically magnetic pole elements N1, N2, N3 and N4 providing N-pole magnetic fields and magnetic pole elements S1, S2 and S3 providing S-pole magnetic fields, are radially arranged apart one from another in the order shown in FIG. 4.

Magnet roller 214 is unrotatably supported and fixed at its both ends by the side walls of developing vessel 200. Magnetic pole element N1 is disposed at a position opposing the peripheral surface of photoreceptor drum 3. Each of the chained lines designated at P1, P2, P3 and P4 of magnetic pole elements N1, N2, N3 and N4 represents the center of the width of the associated magnetic pole element or the central axis of the associated magnetic pole, with respect to the circumferential direction of developing roller 202. These magnetic pole's center axes P1, P2, P3 and P4 are radially extended from the developing roller's central axis O2 and formed across the full length of the magnet elements (across the length of sleeve 215). The magnetic pole element N1 that opposes the peripheral surface of photoreceptor drum 3 is positioned so that the magnetic pole's center axis P1 substantially coincides with the line (plane) that passes through both the center axis (outside the area of FIG. 4) of photoreceptor drum 3 and the center axis O2 of developing roller 202.

The above magnetic pole elements are laid out in the order of N1, S3, N4, N3, S2, N2 and S1 in the rotational direction of developing roller 202. The magnetic field created by the thus arranged magnetic pole elements N1, N2, N3, N4, S1, S2 and S3, attracts the dual-component developer particles made of toner and carrier to the peripheral surface of rotating sleeve 215 so as to form brush-like spikes (to be referred as magnetic brush) extending in the circumferential direction of the sleeve. The photoreceptor drum 3 surface is rubbed in the above-mentioned development gap area by the magnetic brush created by rotating developing roller 202 to thereby achieve development.

Arranged within opening 200*a* of developing vessel 200, adjacent to and below developing roller 202 is carrier collecting roller 220 for collecting the magnetic carrier that has adhered to photoreceptor drum 3 so as to collect the magnetic carrier adhering on photoreceptor drum 3. The magnetic carrier collected by carrier collecting roller 220 is removed by carrier removing device 230. This carrier collecting roller 220 of the present embodiment will be detailed later.

Regulating member 207 controls the amount of the developer conveyed between itself and developing roller 202 while performing principal electrification of the developer, and is formed of a non-magnetic metal plate having an approximately rectangular section. One end of regulating member 207 opposes the outer peripheral surface of developing roller 202 (sleeve 215) with a predetermined gap in between. Regulating member 207 is fixed to a cover element 216 and disposed inside opening 200*a* (FIG. 3). This regulating member 207 is formed of a non-magnetic metal plate such as aluminum, stainless steel or the like.

Mixing roller 204 agitates and conveys the toner supplied from toner feed device 30 (FIG. 3) as shown in FIG. 5A and is comprised of a rotary shaft 204*a* arranged substantially parallel to developing roller 202 (FIG. 4) and a plurality of separate plate-like agitating elements 204*b* (204*b*1 to 204*b*4).

Agitating elements 204*b* are arranged inclined at an angle of approximately 45° with the direction in which the axis of rotary shaft 204*a* extends (to be referred to as the axial direction). Agitating elements 204*b* include agitating element 204*b*3 disposed at the approximate center, with respect to the axial direction, of rotary shaft 204*a*, a group 204B1 of an agitating element 204*b*1 and multiple agitating elements 204*b*2 arranged on the right side in the drawing and a group 204B2 of an agitating element 204*b*4 and multiple agitating elements 204*b*2 arranged on the left side in the drawing. Here, agitating elements 204*b*1 and 204*b*4 are disposed at both ends with respect to the axial direction of rotary shaft 204*a*.

In the present embodiment, group 204B1 includes as many agitating elements 204*b*2 as group 204B2 does. That is, mixing roller 204 has an odd number of agitating elements 204*b*. This provision of an odd number of agitating elements 204*b* makes the overall flow of the developer imbalance and enables agitation and conveyance of the developer in one particular direction.

As shown in FIGS. 5B and 5E, agitating elements 204*b*1 and 204*b*4 arranged at both ends of rotary shaft 204*a* have approximately semicircular shapes which are point symmetrical with respect to rotary axis 204*a*. Detailedly, agitating elements 204*b*1 and 204*b*4 each have a hemi-elliptic shape by cutting an elliptic shape having a major axis L1 passing through rotary axis 204*a* in half along the line that is substantially perpendicular to the major axis L1.

A plurality of agitating elements 204*b*2 are provided between agitating element 204*b*3 and agitating element 204*b*1 and between agitating element 204*b*3 and agitating element 204*b*4, each being inclined with the axial direction of rotary shaft 204*a* and having a substantially elliptic shape, as shown in FIG. 5C. This configuration makes it possible for each agitating element to produce a stronger conveying force in the direction of the rotary axis.

Agitating element 204*b*3 arranged at the substantially center of rotary shaft 204*a* has a substantially elliptic shape having a cutout portion 204*c* at the position opposing the aforementioned toner concentration sensor 213 as shown in FIG. 5D, so that light for detection from toner concentration sensor 213 is permitted to pass through. Another cutout portion 204*c* is formed in the agitating element at a position point symmetrical, with respect to the center of rotary axis 204*a*, to the position of the aforementioned cutout. That is, a pair of cutout portions 204*c* are formed at positions point symmetrical to each other with respect to the center of rotary axis 204*c*. Thus, this configuration of agitating element 204*b*3 makes it possible to prevent output ripples from occurring at toner concentration sensor 213 due to developer's volume density change which would occur as agitating element 204*b* of mixing roller 204 rotates.

Arranged between developing roller 202 and mixing roller 204 as shown in FIG. 4, is paddle roller 203, which agitates and electrifies the developer that was prepared by mixing of mixing roller 204 to supply the developer to developing roller 202.

Paddle roller 203 is formed with a supporting shaft extending longitudinally and a plurality of flat plate-like blades radially extending from the supporting shaft so that the blades can rotate about the supporting shaft. As paddle roller 203 rotates about the supporting shaft, the developer can be agitated.

As described above, carrier collecting roller 220 for collecting the magnetic carrier having adhered to photoreceptor drum 3 is arranged below developing roller 202 so as to abut photoreceptor drum 3. Carrier removing device 230 which removes the magnetic carrier collected by this carrier collecting roller 220 therefrom is arranged at a position on the downstream side with respect to the rotational direction of carrier collecting roller 220.

Figure 6:
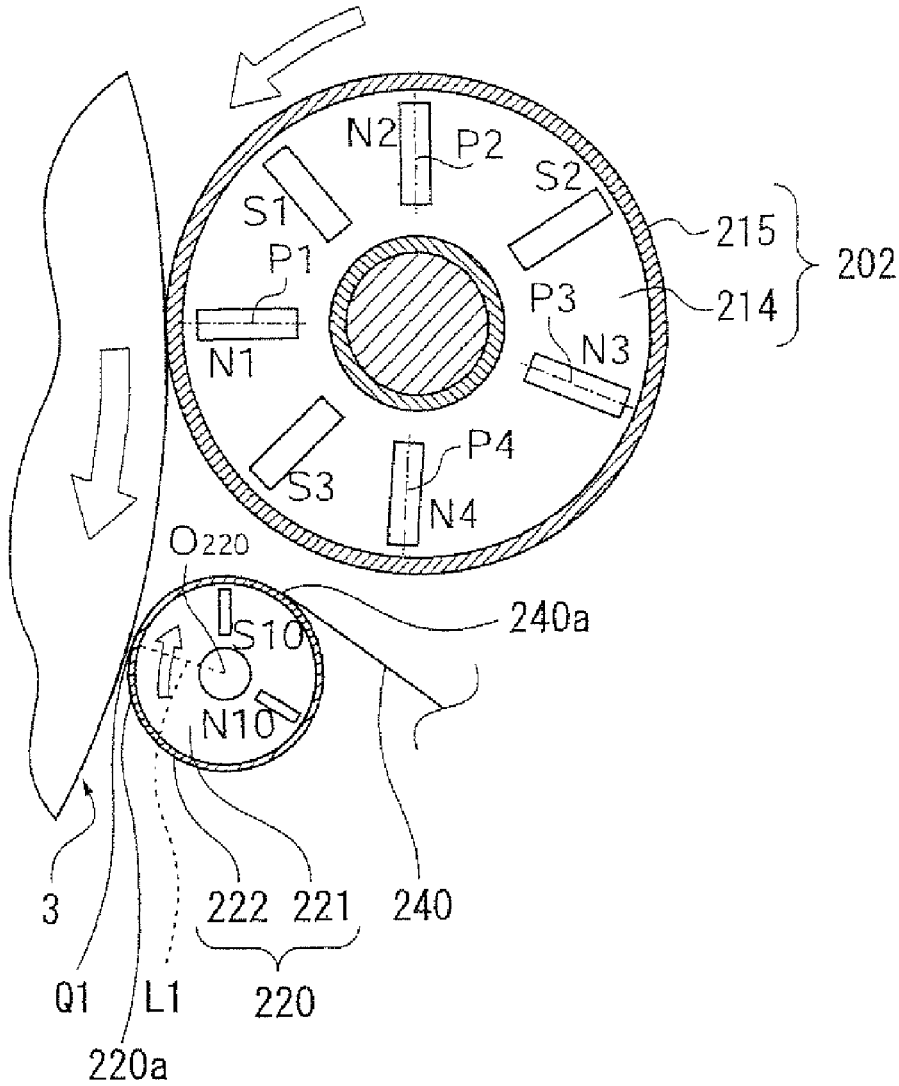
FIG. 6 is an overall configurational side view showing essential parts of a developing roller and carrier collecting roller in the developing unit according to the same embodiment.

Next, developing roller 202 provided for developing unit 2 and its surrounding components according to the present embodiment will be described with reference to the drawings. FIG. 6 is an overall configurational side view showing essential parts of developing roller 202 and carrier collecting roller 220 in the developing unit according to the present embodiment.

Image forming apparatus 1A according to the present embodiment is a high-speed machine with its photoreceptor drum 3 having a rotational speed of 360 mm/sec or greater. Developing unit 2 provided for this image forming apparatus 1A includes developing roller 202 and carrier collecting roller 220 as shown in FIG. 6.

Developing roller 202 has a magnet roller 214 having seven fixed magnetic pole elements N1, N2, N3, N4, S1, S2 and S3 arranged radially from the rotational center thereof, and attracts the developer on the surface of a cylindrical sleeve 215 covering the magnetic roller 214 and rotating relative to the magnet roller so as to supply the developer to photoreceptor drum 3.

Carrier collecting roller 220 is arranged on the downstream side of this developing roller 202 with respect to the rotational direction of photoreceptor drum 3.

As shown in FIG. 6, carrier collecting roller 220 is positioned a small gap of about 1 mm apart from photoreceptor drum 3, and is formed of metal such as aluminum or the like. Carrier collecting roller 220 includes a carrier collecting magnet roller 221 and a carrier collecting sleeve 222.

Carrier collecting magnet roller 221 is a two-polarized magnet roller having two magnetic pole elements S10 and N10 providing S-pole and N-pole magnetic fields respectively. These magnetic pole elements are arranged radially about a rotary shaft $O_{220}$.

Carrier collecting sleeve 222 is a non-magnetic sleeve that is approximately cylindrically formed of an aluminum alloy, brass and the like and is arranged rotatably over, and relative to the carrier collecting magnet roller 221.

Carrier collecting magnet roller 221 is unrotatably supported and fixed at its both ends by the side walls of developing vessel 200. Of magnetic pole elements S10 and N10, N-polarized magnetic pole element N10 is arranged at a position on the opposite side across the center of roller 220 (rotary shaft $O_{220}$), from the position of the carrier collecting roller 220 opposing photoreceptor drum 3. On the other hand, S-polarized magnetic pole element S10 is arranged at a position opposing developing roller 202.

In the present embodiment, the magnetic field strength of these magnetic pole elements S10 and N10 ranges 400 to 750 G. The angle formed between these magnetic pole elements S10 and N10 is set at an angle of 80° to 150°. Further, magnetic pole element N10 is positioned so that the angle formed between magnetic pole element N10 and the line, namely closest center line L1 (or the line connected between the center $O_{220}$ and the center of photoreceptor drum 3) from center $O_{220}$ of carrier collecting roller 220 to the closest point Q1 on the carrier collecting roller 220 surface that is located closest to the photoreceptor drum 3, is equal to or greater than 140° to 180° or smaller. In this case, in order to enable smooth collection of the carrier adhering on photoreceptor drum 3, it is preferable that the closest magnetic pole element S3 of the fixed magnetic pole elements in magnet roller 214 from S-polarized magnetic pole element S10 have the same polarity or are S-polarized.

As to carrier collecting roller 220, a scraper member 240 is arranged on the downstream side of the closest point Q1 with respect to the rotational direction of carrier collecting roller 220. In order to clean the outer peripheral surface, 220*a*, of carrier collecting sleeve 222 of the carrier collecting roller 220, this scraper member 240 is arranged to abut outer peripheral surface 220*a*, to thereby scrape the toner, toner additives and other wastes. In the present embodiment, scraper member 240 is arranged with its proximal end fixed to one end of carrier removing device 230 as shown in FIG. 4. In this embodiment, in order to enable efficient removal of the toner and its external additives etc. adhering on outer peripheral surface 220*a* of carrier collecting roller 220, the distal end, designated at 240*a*, of scraper member 240 abuts outer peripheral surface 220*a* of carrier collecting roller 220, at the position where the magnetic force in the direction perpendicular to outer peripheral surface 220*a* is weakest. Here in the present embodiment, scraper 240 is formed of stainless steel of 0.1 [mm] thick (SUS/0.1 t). However, the scraper should not be limited to this material and thickness.

In the above way, in the present embodiment, instead of arranging magnetic pole elements S10 and N10 in carrier collecting roller 220 at the position opposing photoreceptor drum 3 (on th closest center line L1), a magnetic pole element N10 having a magnetic field intensity of 400 to 750 G is arranged at a position on the opposite side across the center of carrier collecting roller 220 from the aforementioned position opposing photoreceptor drum 3 while a magnetic pole element S10 having a magnetic field intensity of 400 to 750 G is arranged at a position opposing developing roller 202. In this arrangement wherein outer periphery surface of carrier collecting roller 220 is located at the position opposing photoreceptor drum 3 (surface opposing photoreceptor drum), magnetic pole elements S10 and N10 produce leakage magnetic fields, having a high enough magnetic field intensity of about 35 G to 80 G to collect the carrier and spreading over a wide range with respect to the rotational direction of carrier collecting roller 220. That is, the magnetic carrier can be reliably collected by the leakage magnetic fields. Here, if the magnetic field intensity of magnetic pole elements S10 and N10 is lower than 400 G, no effective leakage magnetic field will appear on the surface opposing the photoreceptor drum, whereas if it is greater than 750 G, the carrier cannot be collected smoothly by carrier collecting roller 220.

In the conventional configuration in which a magnetic pole element is arranged on the side opposing the photoreceptor drum, the spread of the magnetic field that contributes to collection of the carrier with respect to the rotational direction of the carrier collecting roller is narrow, and the direction of the magnetic field effective in collecting the carrier from photoreceptor drum 3 is unidirectional.

In contrast, in the present embodiment, the aforementioned arrangement of the magnetic pole elements creates a magnetic field that is effective over a wide circumferential range along the outer peripheral surface 220*a*, the direction of the magnetic field on the photoreceptor drum 3 surface that contributes to collection of the carrier results in being multidirectional.

Accordingly, in the present embodiment, since the leakage magnetic field having a high enough magnetic intensity to collect the carrier and oriented in multi-directions appears over the wide range of the carrier collecting roller 200's surface opposing the photoreceptor drum, it is possible to collect the carrier efficiently even from the photoreceptor drum 3 that is rotating at high speed. Further, since the leakage magnetic field spreads over a wide range and is oriented in multi-directions, the distance between the neighboring magnetic poles in effect becomes shorter compared to the conventional configuration. As a result, conveyance of the collected carrier can also be improved.

Further, when the angle formed between the magnetic poles of magnetic pole elements S10 and N10 is specified in the range from 80° to 150° and the angle formed between magnetic pole element N10 and the closest center line L1 is specified in the range from 140° to 180°, magnetic fields leaking from magnetic pole elements S10 and N10 that are strong enough as about 35 G to 80 G to collect the carrier appears on the opposite side from magnetic pole element N10, or on the side of carrier collecting roller 220 opposing the photoreceptor drum. Accordingly, even when a small-diametric carrier is used in high-speed processing image forming apparatus 1A, it is possible to efficiently collect the adhering carrier particles.

In the above case, if the angle between magnetic pole elements S10 and N10 in carrier collecting roller 220 is smaller than 80°, the carrier collecting roller 220 cannot function to collect the carrier since no magnetic field will leak out in multi-directions spreading over a wide range in the area opposing the photoreceptor drum on the opposite side from magnetic pole element N10 but only a leakage magnetic field having a narrow angle appears near magnetic pole element N10. On the other hand, if the angle is greater than 150°, it is infeasible to construct the arrangement of the present embodiment in which magnetic pole element S10 is arranged at a position opposing developing roller 202 and magnetic pole element N10 is arranged at a position on the opposite side across the roller center from the photoreceptor drum opposing side. Accordingly, it is no longer necessary to take the angle between the two magnetic pole to be greater than 150°. In conclusion, the angle between magnetic pole elements S10 and N10 should range from 80° to 150° as described above. The relationship between the angle formed between magnetic pole elements S10 and N10 in carrier collecting roller 220 and the collected amount of the carrier by carrier collecting roller 220 will be detailed later.

In connection with this embodiment, developing unit 2 is adapted for use in a high-speed machine with its photoreceptor drum 3 having a rotational speed of 360 mm/sec or greater. More illustratively, when the rotational speed of photoreceptor drum 3 is 360 mm/sec or greater, the carrier particles fly off photoreceptor drum 3 and are captured by the leakage magnetic field generated by magnetic pole element N10 of carrier collecting roller 220 that does not oppose photoreceptor drum 3. On the other hand, the carrier remaining on photoreceptor drum 3 is collected by the leakage magnetic field from carrier collecting roller 220. Suppose that the rotational speed of photoreceptor drum 3 is lower than 360 mm/sec, for example, it is set at 250 mm/sec, no carrier particles will scatter, hence no carrier will be collected unless the magnetic pole in the carrier collecting roller 220 opposes photoreceptor drum 3. That is, carrier collecting roller 220 of the present embodiment cannot play its role when the rotational speed is low.

When developing unit 2 is constructed as described above, the carrier collecting roller 220 provided for developing unit 2 is able to efficiently collect the adhering carrier and convey it to carrier removing device 230 even if image forming apparatus 1A is a high-speed processing machine using a small-sized carrier. Accordingly, it is possible to suppress the carrier from lowering the contact of the printing material to photoreceptor drum 3 during transfer and from degrading the transferred image with so-called white voids and the like, which would occur if the carrier adheres to the photoreceptor drum 3.

Example 1

Figures 17A, 17B:
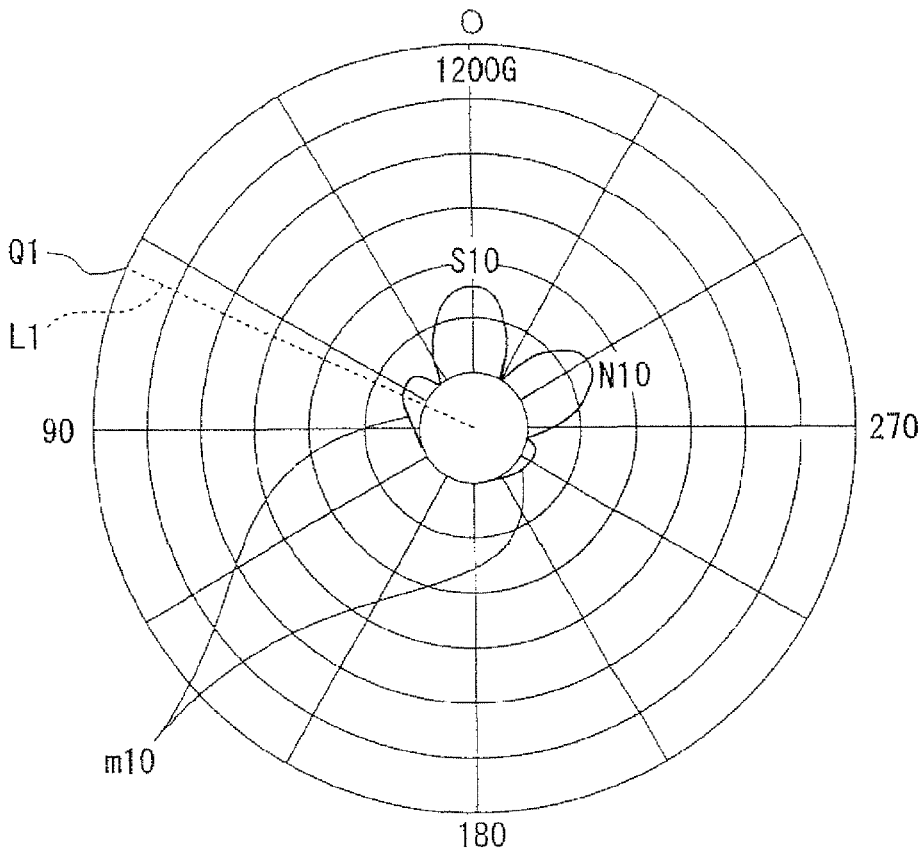
FIG. 17A is a table showing the measurement result of the magnetic field intensities as to a carrier collecting roller in which the magnetic field intensity of magnetic pole N10 is set at 292 G, the angle between the poles of magnetic pole elements S10 and N10 is set at 62.83° and the angle formed between the magnetic pole element N10 and the closest center line L1 is set at 128.04°.
FIG. 17B is a chart showing the intensity distribution of the magnetic field formed by the carrier collecting roller set up with the conditions shown in the table of FIG. 17A.

Next, example 1 for determining the preferable specifications of the individual magnetic pole elements provided for the carrier collecting roller in the present embodiment will be described. FIG. 7 is a table for representing the evaluation of the effects in accordance with the setup conditions of the magnetic pole elements provided for the carrier collecting roller in example 1 of the developing unit of the present embodiment. FIG. 8 is a table showing the relationships between the magnetic intensities and the magnetic poles of the magnet roller in the developing roller of example 1 of the developing unit of the same embodiment. FIGS. 9 to 17 are charts showing experimental data based on which the preferable ranges of the magnetic field intensities and the angle between magnetic poles of the magnetic pole elements in the carrier collecting rollers of the developing unit in the present embodiment are determined. FIGS. 9A, 10A, 11A, 12A, 13A, 14A, 15A, 16A and 17A are each a table showing the magnetic field intensities of the magnetic pole elements of the carrier collecting roller in relation with the angle formed between the magnetic poles and the angle between magnetic pole element N10 and the closest center line L1. FIGS. 9B, 10B, 11B, 12B, 13B, 14B, 15B, 16B and 17B are each a chart showing the intensity distribution of the magnetic field formed by the carrier collecting roller. FIGS. 9 to 17 show the data when the magnetic field intensity of magnetic pole N10, the angle between the magnetic poles and the angle between magnetic pole element N10 and the closest center line L1 are: 285 G, 70.00°, 133.23° (FIG. 9); 427 G, 100.1°, 163.74° (FIG. 10); 452 G, 99.42°, 160.10° (FIG. 11); 589 G, 98.7°, 160.83° (FIG. 12); 658 G, 140.7°, 149.29° (FIG. 13); 734 G, 103.45°, 169.10° (FIG. 14); 893 G, 102.54°, 165.34° (FIG. 15); 297 G, 51.77°, 114.25° (FIG. 16); and 292 G, 62.83°, 128.04° (FIG. 17). Here in FIGS. 9B, 10B, 11B, 12B, 13B, 14B, 15B, 16B and 17B, the magnitude of the magnetic field formed by each magnetic pole element is represented by the component of the magnetic field normal to the peripheral surface of the magnet roller (which will be referred to hereinbelow as "the normal component").

In example 1, the processing conditions are set up as follows: —a carrier has a mean particle diameter of 40 μm and a magnetic property (mass magnetization) of 65 emu/g; carrier collecting roller 220 includes magnetic pole elements S10 and N10 fixed 120° apart from each other, has a diameter of ϕ12 mm and is rotated at a rotational speed ratio of 1/108 relative to the rotational speed of magnet roller 215; magnet (developing) roller 215 has a diameter of ϕ30 mm and is rotated at a rotational speed ratio of 2.0 relative to the rotational speed of photoreceptor drum 3; the carrier collecting roller 220 and magnet roller 215 are arranged a gap of 3 mm apart from each other; the carrier collecting roller 220 and photoreceptor drum 3 are arranged a gap of 0.8 mm apart from each other; the sleeve is formed of aluminum with 80 V-shaped grooves formed on the surface thereof; and the rotational speed of photoreceptor drum 3 is set at 540 mm/sec, 360 mm/sec and 250 mm/sec.

In example 1 set up with the above conditions, the relationships involving the magnetic field intensities of the normal poles and the effective angle of the magnetic pole for carrier collection, the leakage magnetic field intensity of the normal magnetic poles and the effective angle of the leakage magnetic field as shown in FIG. 7 are obtained. From these data, it is understood that when the magnetic intensities of magnetic pole elements N10 and S10 are equal to 427 G or greater the effective angle of the leakage magnetic field becomes wide and the image quality evaluation improves correspondingly.

In addition, in FIG. 7, the decrements of the carrier and the resultant image quality of the formed images after an actual print aging run of 500 k ($k=10^3$) with the rotational speed of photoreceptor drum 3 set at 360 mm/sec, 540 mm/sec and 250 mm/sec are shown. From the data shown in FIG. 7, it is understood that use of the carrier collecting roller 220 makes it possible to markedly inhibit reduction of the carrier when the rotational speed of the photoreceptor drum is set at 350 mm/sec or greater. In particular, it is obvious that carrier reduction can be suppressed and image failures due to carrier adherence can be improved away when the magnetic field intensity of magnetic poles N10 and S10 falls in a range from 427 to 734 G.

Figures 9A, 9B:
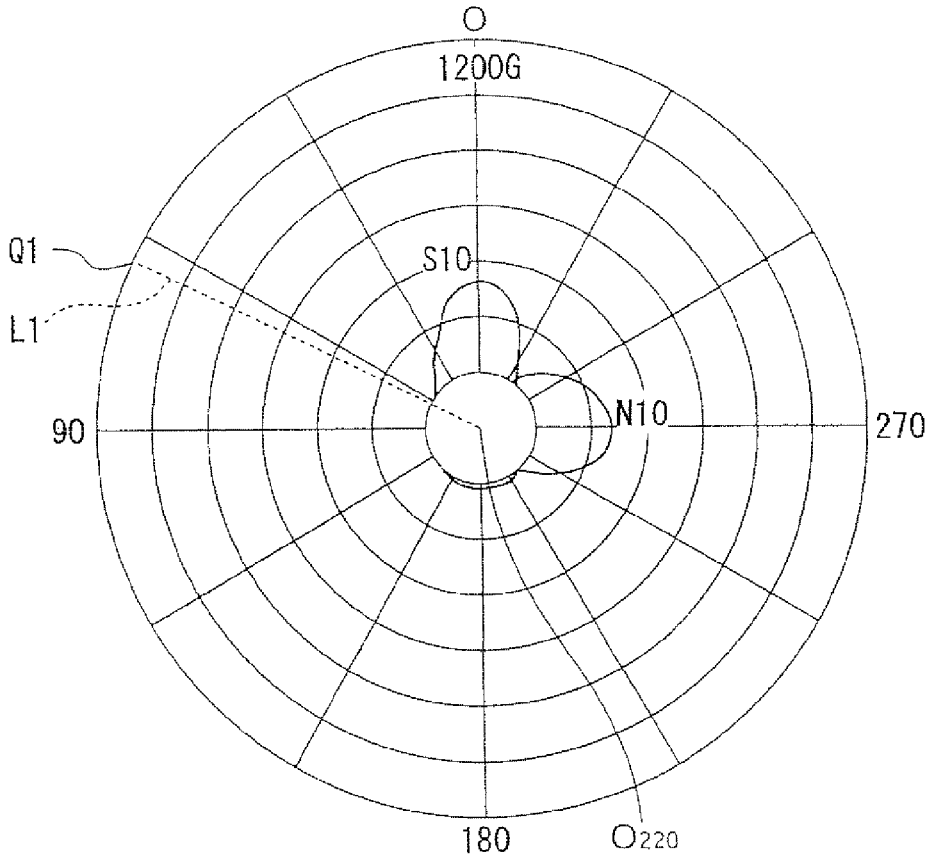
FIG. 9A is a table showing the measurement result of the magnetic field intensities as to a carrier collecting roller in which the magnetic field intensity of magnetic pole N10 is set at 285 G, the angle between the poles of magnetic pole elements S10 and N10 is set at 70.00° and the angle formed between the magnetic pole element N10 and the closest center line L1 is set at 133.23°.
FIG. 9B is a chart showing the intensity distribution of the magnetic field formed by the carrier collecting roller set up with the conditions shown in the table of FIG. 9A.
Figures 10A, 10B:
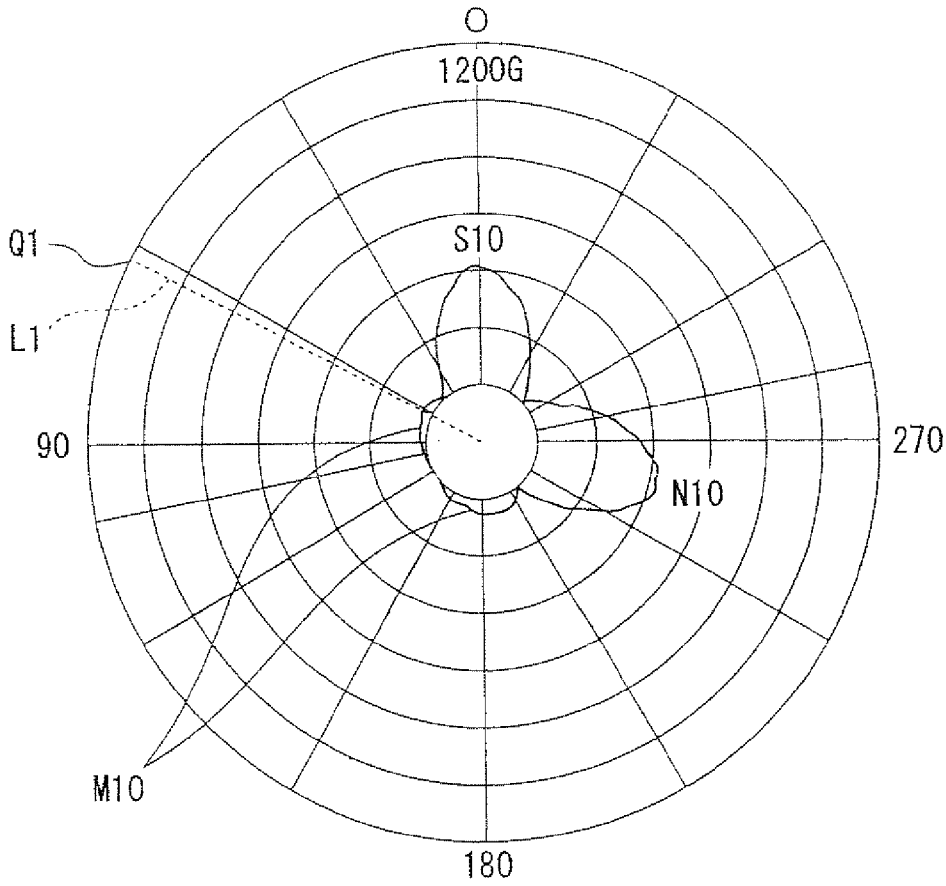
FIG. 10A is a table showing the measurement result of the magnetic field intensities as to a carrier collecting roller in which the magnetic field intensity of magnetic pole N10 is set at 427 G, the angle between the poles of magnetic pole elements S10 and N10 is set at 100.1° and the angle formed between the magnetic pole element N10 and the closest center line L1 is set at 163.74°.
FIG. 10B is a chart showing the intensity distribution of the magnetic field formed by the carrier collecting roller set up with the conditions shown in the table of FIG. 10A.
Figures 11A, 11B:
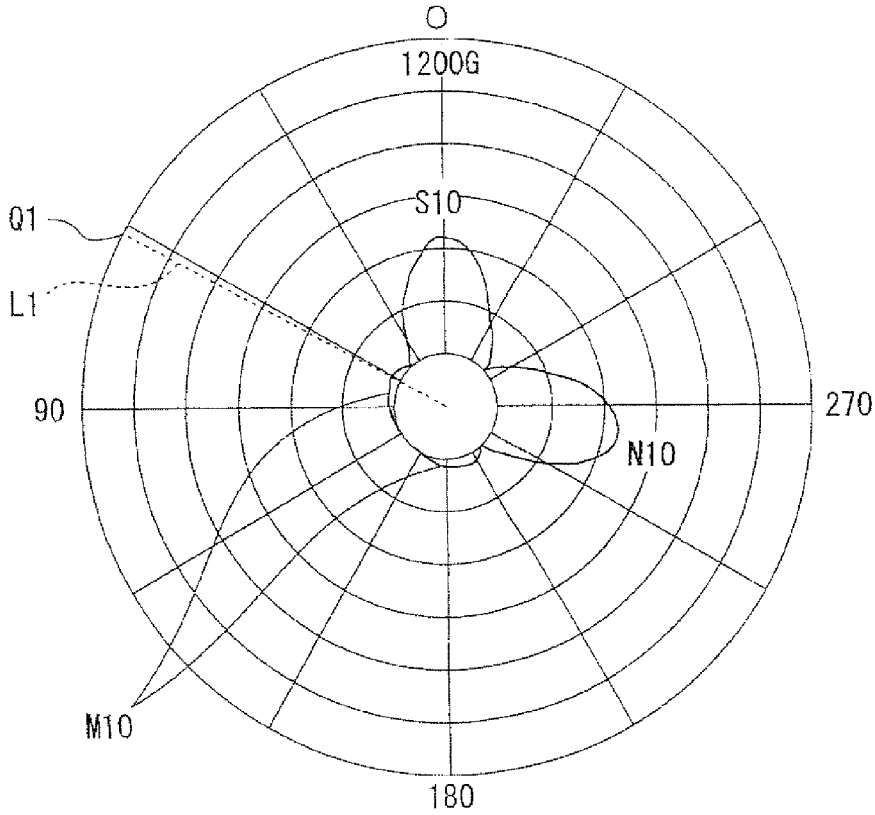
FIG. 11A is a table showing the measurement result of the magnetic field intensities as to a carrier collecting roller in which the magnetic field intensity of magnetic pole N10 is set at 452 G, the angle between the poles of magnetic pole elements S10 and N10 is set at 99.42° and the angle formed between the magnetic pole element N10 and the closest center line L1 is set at 160.10°.
FIG. 11B is a chart showing the intensity distribution of the magnetic field formed by the carrier collecting roller set up with the conditions shown in the table of FIG. 11A.
Figures 12A, 12B:
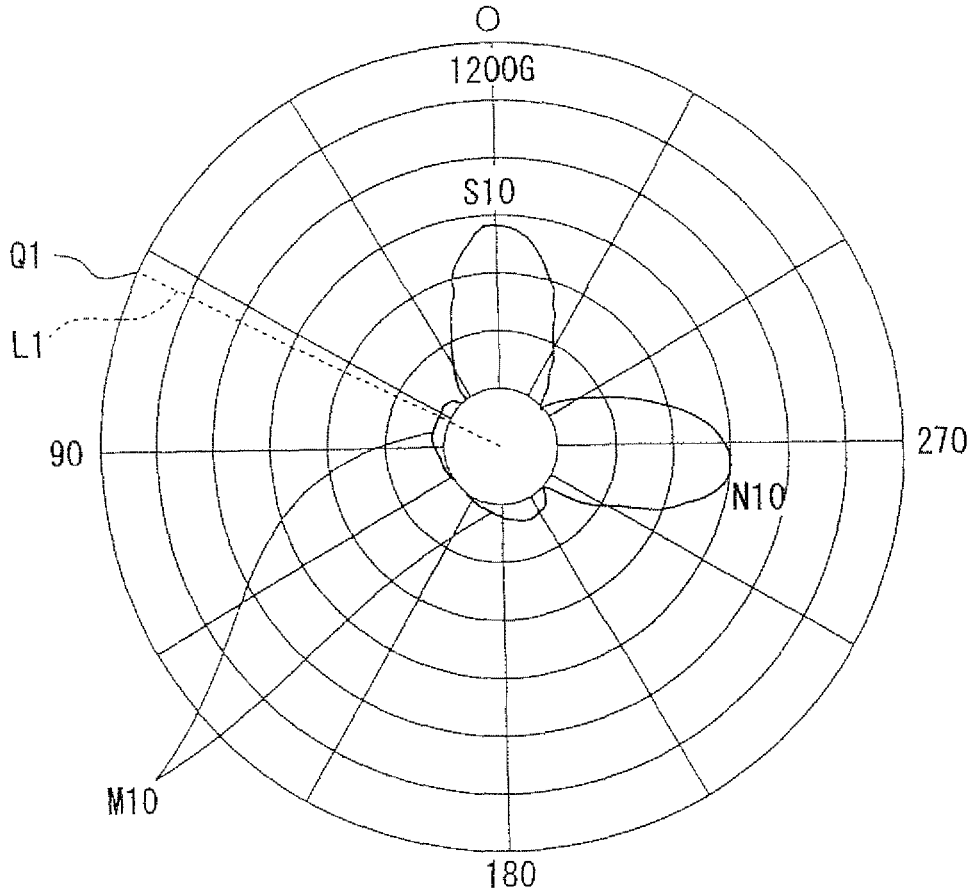
FIG. 12A is a table showing the measurement result of the magnetic field intensities as to a carrier collecting roller in which the magnetic field intensity of magnetic pole N10 is set at 589 G, the angle between the poles of magnetic pole elements S10 and N10 is set at 98.7° and the angle formed between the magnetic pole element N10 and the closest center line L1 is set at 160.83°.
FIG. 12B is a chart showing the intensity distribution of the magnetic field formed by the carrier collecting roller set up with the conditions shown in the table of FIG. 12A.
Figures 13A, 13B:
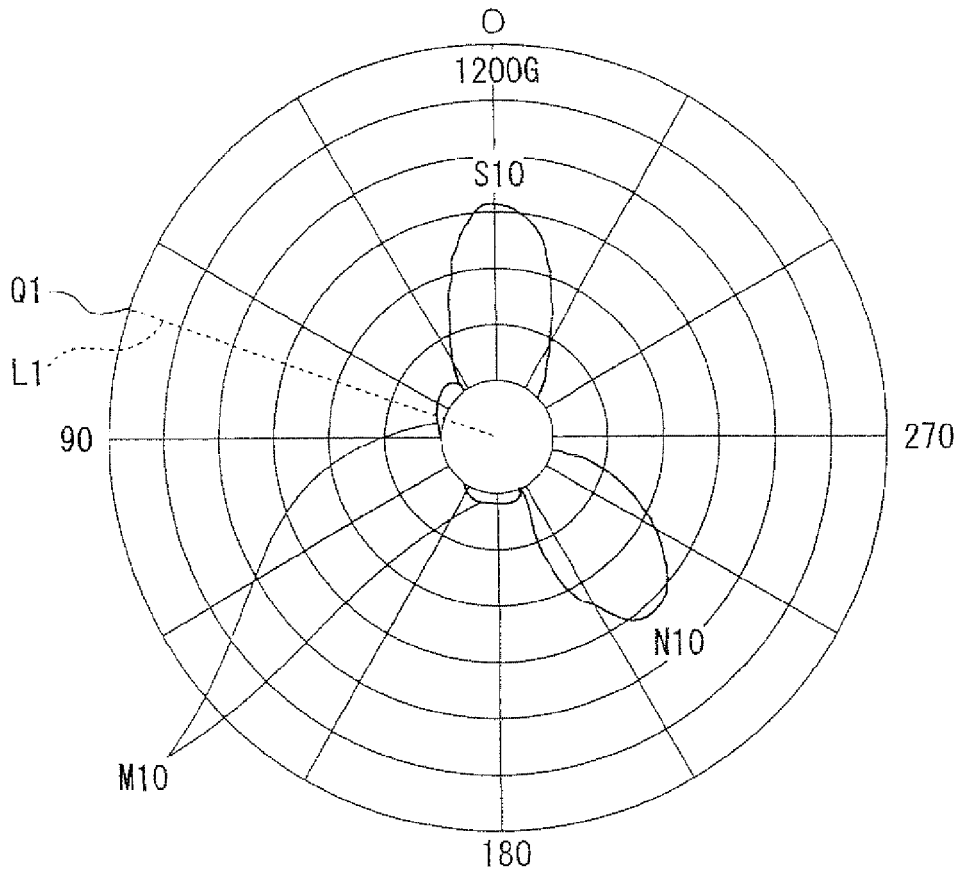
FIG. 13A is a table showing the measurement result of the magnetic field intensities as to a carrier collecting roller in which the magnetic field intensity of magnetic pole N10 is set at 658 G, the angle between the poles of magnetic pole elements S10 and N10 is set at 140.7° and the angle formed between the magnetic pole element N10 and the closest center line L1 is set at 149.29°.
FIG. 13B is a chart showing the intensity distribution of the magnetic field formed by the carrier collecting roller set up with the conditions shown in the table of FIG. 13A.
Figures 14A, 14B:
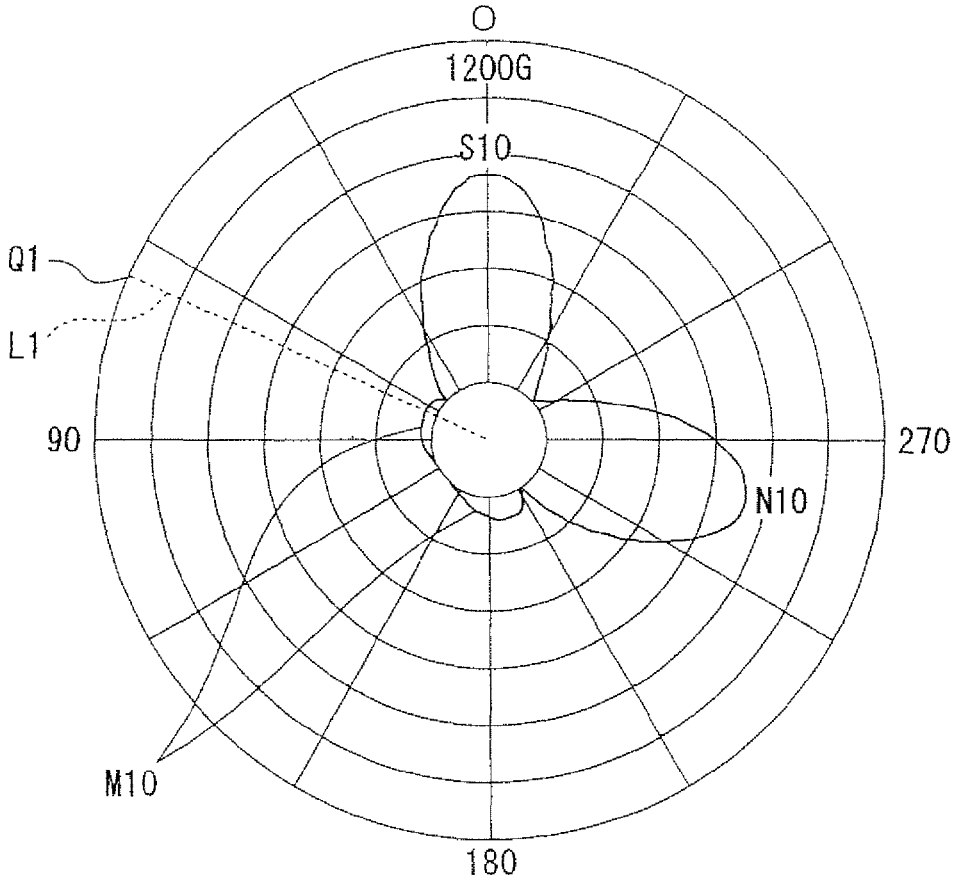
FIG. 14A is a table showing the measurement result of the magnetic field intensities as to a carrier collecting roller in which the magnetic field intensity of magnetic pole N10 is set at 734 G, the angle between the poles of magnetic pole elements S10 and N10 is set at 103.45° and the angle formed between the magnetic pole element N10 and the closest center line L1 is set at 169.10°.
FIG. 14B is a chart showing the intensity distribution of the magnetic field formed by the carrier collecting roller set up with the conditions shown in the table of FIG. 14A.

When the magnetic field intensities of magnetic poles N10 and S10 are smaller than 400 G, no magnetic field leaking from magnetic poles N10 and S10 appears on the surface that includes the drum closest point Q1 opposing the photoreceptor drum, as shown in FIG. 9B. In contrast, when the magnetic field intensities of magnetic poles N10 and S10 are equal to or greater than 400 G, a magnetic field M10 leaking from magnetic poles N10 and S10 appears on the surface that includes the drum closest point Q1 opposing the photoreceptor drum, as shown in FIGS. 10 to 14. This leakage magnetic field is strong enough as high as 35 G to 80 G to collect the carrier. Accordingly, even if a small sized carrier is used in a high-speed image forming apparatus 1A, it is possible to collect the carrier adhering on photoreceptor drum 3 in an efficient manner by the function of the leakage magnetic field M10 that appears covering a wide area over the surface that includes the drum closest point Q1 opposing the photoreceptor drum.

Figures 15A, 15B:
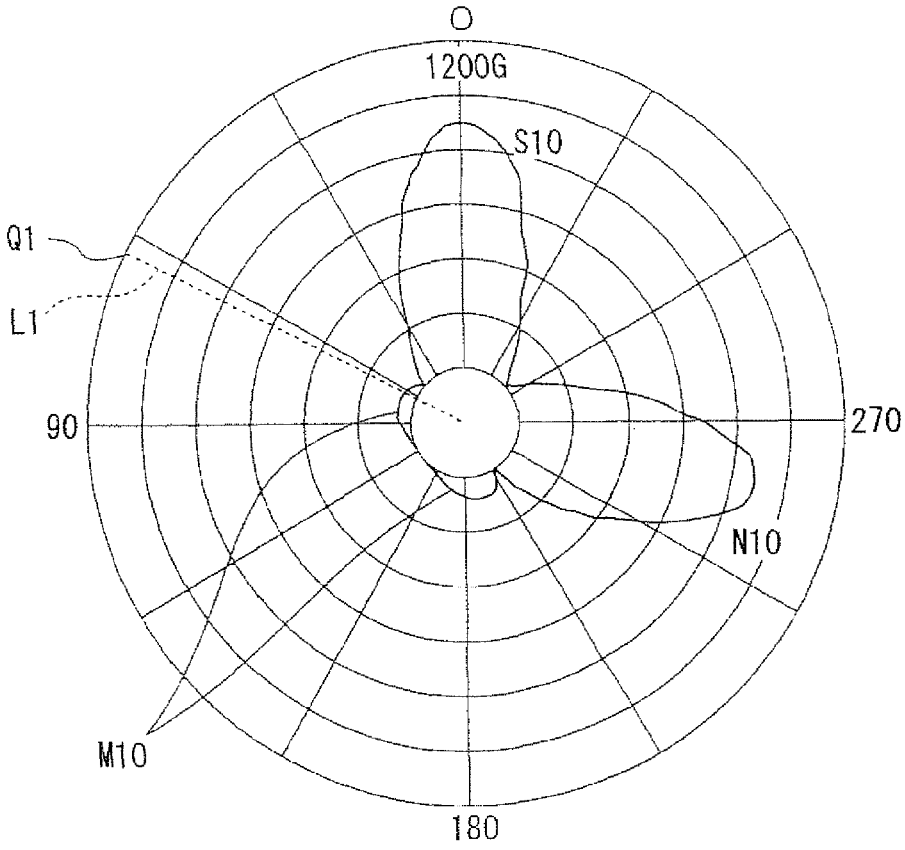
FIG. 15A is a table showing the measurement result of the magnetic field intensities as to a carrier collecting roller in which the magnetic field intensity of magnetic pole N10 is set at 893 G, the angle between the poles of magnetic pole elements S10 and N10 is set at 102.54° and the angle formed between the magnetic pole element N10 and the closest center line L1 is set at 165.34°.
FIG. 15B is a chart showing the intensity distribution of the magnetic field formed by the carrier collecting roller set up with the conditions shown in the table of FIG. 15A.
Figures 16A, 16B:
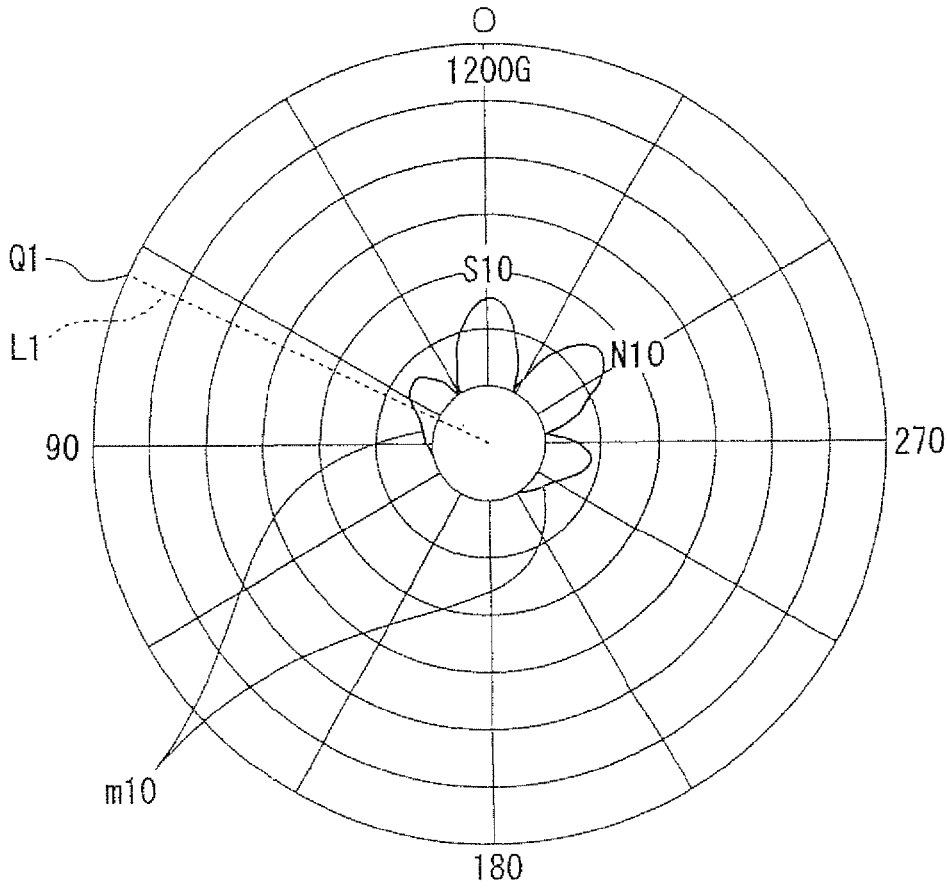
FIG. 16A is a table showing the measurement result of the magnetic field intensities as to a carrier collecting roller in which the magnetic field intensity of magnetic pole N10 is set at 297 G, the angle between the poles of magnetic pole elements S10 and N10 is set at 51.77° and the angle formed between the magnetic pole element N10 and the closest center line L1 is set at 114.25°.
FIG. 16B is a chart showing the intensity distribution of the magnetic field formed by the carrier collecting roller set up with the conditions shown in the table of FIG. 16A.

When the magnetic field intensities of magnetic poles N10 and S10 are greater than 750 G, or set at 893 G, a magnetic field M10 leaking from magnetic poles N10 and S10 appears on the surface that includes the drum closest point Q1 opposing the photoreceptor drum, as shown in FIG. 15B. In this case, however, the decrement of the carrier increases, and the evaluation on the image quality lowers accordingly due to image failures caused by carrier adhesion, as shown in FIG. 7. In example 1, of the magnetic pole elements included in developing roller 202, the magnetic field intensity of magnetic pole element S3 that is closest to carrier collecting roller 220 is known to be 924 G from the table shown in FIG. 8. In this condition, when the magnetic field intensities of the magnetic pole elements S10 and N10 of carrier collecting roller 220 are greater than 750 G, the carrier on carrier collecting roller 220 is hard to transfer to developing roller 202, hence the collected carrier remains on the carrier collecting roller. This makes it difficult for the newly arriving carrier to transfer to the outer peripheral surface 220*a* of carrier collecting roller 220. As a result, the carrier collecting efficiency at carrier collecting roller 220 lowers, the decrement of the carrier is resultantly unable to be controlled and increases.

When the angle formed between magnetic pole elements S10 and N10 is smaller than 80°, no leakage magnetic field that is oriented multi-directionally ranging widely over outer peripheral surface 220*a* of carrier collecting roller 220 on the opposite side from magnetic pole element N10 appears but leakage magnetic fields m10 having small effective angles appear near magnetic pole elements S10 and N10 as shown in FIGS. 16 and 17. As a result it is impossible for carrier collecting roller 220 to provide its expected function. On the other hand, when the angle formed between magnetic pole elements S10 and N10 is equal to or greater than 80°, leakage magnetic fields M10 having a strong enough magnetic field intensity of about 35 G to 80 G and spreading over a wide range of carrier collecting roller 220 to collect the carrier appear as shown in FIGS. 10 to 14 on the opposite side across center $O_{220}$ from magnetic pole element N10 opposing the photoreceptor drum, being oriented multi-directionally, it is hence possible to make carrier collecting roller 220 function properly.

Further, when the angle formed between magnetic pole element N10 and the closest center line L1 is equal to or greater than 140°, leakage magnetic fields M10 having a strong enough magnetic field intensity of about 35 G to 80 G and spreading over a wide range to collect the carrier appear as shown in FIGS. 10 to 14 on the side opposing the photoreceptor drum, being oriented multi-directionally. On the other hand, when the angle formed between magnetic pole element N10 and the closest center line L1 is smaller than 140°, no leakage magnetic field that is oriented multi-directionally ranging widely over the surface opposing the photoreceptor drum appears as shown in FIGS. 9, 16 and 17, it is hence impossible for carrier collecting roller 220 to provide its proper function.

Additionally, in the present embodiment, in order to enable efficient removal of the toner and its external toner additives etc. adhering on outer peripheral surface 220*a* of carrier collecting roller 220, distal end 240*a* of scraper member 240 preferably abuts outer peripheral surface 220*a* of carrier collecting roller 220, at the position where the magnetic force perpendicular to outer peripheral surface 220*a* is weakest. Specifically, in the example shown in FIG. 12, the distal end is preferably abutted against the exact center of magnetic pole elements S10 and N10.

In the above way, carrier collecting roller 220 has a pair of N and S poles arranged at positions not opposing photoreceptor drum 3, the magnetic field intensity of each magnetic pole being set at 400 G to 750 G, as shown in example 1. This arrangement enables leakage magnetic fields M10 that are strong enough as about 35 G to 80 G to collect the carrier to appear over a wide angular range with respect to the rotational direction of carrier collecting roller 220, compared to the conventional case in which a magnetic pole is set at the position opposing photoreceptor drum 3. Accordingly, the effective angle of the magnetic field over the surface opposing the photoreceptor drum can be made greater than that of the magnetic pole in the conventional configuration. This contributes to more efficient collection of the carrier even if photoreceptor drum 3 rotates at high speed. Further, since the distance between the neighboring magnetic poles in carrier collecting roller 220 in effect becomes shorter, this makes it smooth to convey the collected carrier and also enables efficient recollection of the carrier to the developing roller side by the magnetic field of the magnet roller 215. Further, this configuration makes it possible to collect and convey the carrier more efficiently than the conventional five-polarized magnet roller, and contributes to reduction in cost.

Having described the preferred embodiment with reference to the attached drawings, it goes without saying that the technology should not be limited to the above-described examples, and it is obvious that various changes and modifications will occur to those skilled in the art within the scope of the appended claims. Such variations are therefore understood to be within the technical scope of the technology.

For example, though, in the above-described first embodiment, the technology is applied to a developing unit that is mounted to a monochrome image forming apparatus including a single toner container, it is also possible to apply the carrier collecting roller of the present technology to a developing unit for color printing including a plurality of toner containers.

What is claimed is:

1. A developing unit for developing an electrostatic latent image formed on an outer peripheral surface of a latent image bearer rotating in one direction with an electrified developer that is prepared by mixing two components, or an electrostatically chargeable toner and magnetic carrier, comprising:

a developing roller formed of a magnet roller incorporating a plurality of fixed magnetic pole elements and a cylindrical sleeve that rotates relative to the magnet roller for supplying the developer to the latent image bearer, by attracting the developer on the surface of the rotating cylindrical sleeve; and a carrier collecting roller disposed on the downstream side of the developing roller with respect to the rotational direction of the latent image bearer, characterized in that the carrier collecting roller includes only first and second magnetic pole elements having different magnetic polarities, both presenting a magnetic field intensity of 400 G to 750 G;

the first magnetic pole element is disposed at a position on the opposite side across a center of the carrier collecting roller from a position opposing the latent image bearer; and the second magnetic pole element is disposed at a position opposing the developing roller.

2. The developing unit according to claim 1, wherein the angle formed between the first and second magnetic pole elements is equal to or greater than 80°.

3. The developing unit according to claim 2, wherein an angle formed between the first and second magnetic pole elements is less than 150°.

4. The developing unit according to claim 3, wherein an angle formed between the first magnetic pole element and a line joining a center of the carrier collecting roller to a point on the carrier collecting roller that is located closest to the latent image bearer is equal to or greater than 140°.

5. The developing unit according to claim 4, wherein a tip end of a scraper member abuts an outer peripheral surface of the carrier collecting roller at a position where a magnetic force perpendicular to the outer peripheral surface is weakest.

6. The developing unit according to claim 5, wherein a fixed magnetic pole in the magnet roller of the developing roller that is located closest to the carrier collecting roller and the second magnetic pole element in the carrier collecting roller that is located closest to the developing roller have the same magnetic polarity.

7. The developing unit according to claim 1, wherein the angle formed between the first magnetic pole element and a line joining a center of the carrier collecting roller to a point on the carrier collecting roller that is located closest to the latent image bearer is equal to or greater than 140°.

8. The developing unit according to claim 7, wherein, a fixed magnetic pole in the magnet roller of the developing roller that is located closest to the carrier collecting roller and the second magnetic pole element in the carrier collecting roller that is located closest to the developing roller have the same magnetic polarity.

9. The developing unit according to claim 8, wherein a tip end of a scraper member abuts an outer peripheral surface of the carrier collecting roller at a position where a magnetic force perpendicular to the outer peripheral surface is weakest.

10. The developing unit according to claim 1, wherein the peripheral velocity of the latent image bearer is equal to or greater than 360 mm/sec.

11. The developing unit according to claim 1, wherein a scraper member is provided contacting an outer peripheral surface of the carrier collecting roller downstream from a point on the carrier collecting roller that is located closest to the latent image bearer with respect to the rotational direction of the carrier collecting roller to scrape wastes adhering on the outer peripheral surface.

12. The developing unit according to claim 11, wherein a tip end of the scraper member abuts the outer peripheral surface of the carrier collecting roller a position where a magnetic force perpendicular to the outer peripheral surface is weakest.

13. The developing unit according to claim 12, wherein a fixed magnetic pole in the magnet roller of the developing roller that is located closest to the carrier collecting roller and the second magnetic pole element in the carrier collecting roller that is located closest to the developing roller have the same magnetic polarity.

14. The developing unit according to claim 13, wherein an angle formed between the first and second magnetic pole elements is between 80° and 150°.

15. The developing unit according to claim 1, wherein, a fixed magnetic pole in the magnet roller of the developing roller that is located closest to the carrier collecting roller and the second magnetic pole element in the carrier collecting roller that is located closest to the developing roller have the same magnetic polarity.

16. An image forming apparatus comprising a developing unit according to claim 1.

* * * * *